US010902777B1

(12) United States Patent
Huang et al.

(10) Patent No.: US 10,902,777 B1
(45) Date of Patent: Jan. 26, 2021

(54) ADAPTIVE PARKING VOLTAGE TUNING TO OPTIMIZE DISPLAY FRONT-OF-SCREEN WITH DYNAMIC SUPPLY VOLTAGE

(71) Applicant: Apple Inc., Cupertino, CA (US)

(72) Inventors: Ruo-Gu Huang, San Jose, CA (US); Kyung Hoae Koo, San Jose, CA (US); Michael H. Lim, Cupertino, CA (US); Chuang Qian, Santa Clara, CA (US); Weijun Yao, Saratoga, CA (US); Yue Jack Chu, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/505,556

(22) Filed: Jul. 8, 2019

(51) Int. Cl.
*G09G 3/3291* (2016.01)
*G09G 3/3233* (2016.01)

(52) U.S. Cl.
CPC ..... *G09G 3/3233* (2013.01); *G09G 3/3291* (2013.01); *G09G 2310/061* (2013.01); *G09G 2320/0247* (2013.01); *G09G 2340/0435* (2013.01)

(58) Field of Classification Search
None
See application file for complete search history.

(56) References Cited

U.S. PATENT DOCUMENTS

2005/0057191 A1* 3/2005 Jo ..... G09G 3/3233 315/291
2017/0092192 A1* 3/2017 Lin ..... G09G 3/3258
2018/0061311 A1* 3/2018 Lin ..... G09G 3/3233
2019/0158793 A1* 5/2019 Oh ..... G09G 5/10

* cited by examiner

*Primary Examiner* — Parul H Gupta
(74) *Attorney, Agent, or Firm* — Kilpatrick Townsend & Stockton LLP

(57) ABSTRACT

A display driver is disclosed that reduces first frame dimming and flicker in light-emitting diode pixels of a display device. The display driver may receive a display brightness value and determine a value of a dynamic supply voltage parameter based on the display brightness value. Over a first time interval, the display driver may apply a supply voltage that is based on the dynamic supply voltage parameter to one of a gate of a drive transistor of a light-emitting-diode circuit and a channel of the drive transistor. Over a second time interval, the display driver may apply a parking voltage to an anode of a light-emitting diode of the light-emitting-diode circuit and to the channel of the drive transistor. The value of the parking voltage may be below a threshold voltage of the light-emitting diode and correspond to the value of the dynamic supply voltage parameter.

20 Claims, 24 Drawing Sheets

ADAPTIVE PARKING VOLTAGE TUNING TO OPTIMIZE DISPLAY FRONT-OF-SCREEN WITH DYNAMIC SUPPLY VOLTAGE

FIELD

The present disclosure relates generally to electronic devices and, more particularly, to electronic devices with displays.

BACKGROUND

Electronic devices often include displays for displaying information to users. Displays such as organic light-emitting diode displays have an array of display pixels based on light-emitting diodes. In this type of display, each display pixel includes a light-emitting diode and thin-film transistors for controlling application of a signal to the light-emitting diode to produce light.

Threshold voltage variations in the thin-film transistors can cause undesired visible display artifacts. For example, threshold voltage hysteresis can cause white pixels to be displayed differently depending on context. For instance, if a set of white pixels remains white between a first frame and a second frame, the set of pixels may be displayed accurately. Yet, if the set of pixels transition from black to white between frames, the white pixels may be displayed inaccurately, such as appearing gray rather than white. This type of history-dependent behavior of the light output of the display pixels in a display causes the display to exhibit a low response time. To address the issues associated with threshold voltage variations, displays such as organic light-emitting diode displays are provided with threshold voltage compensation circuitry. Such circuitry may not, however, adequately address all threshold voltage variations, may not satisfactorily improve response times, and/or may have a design that is difficult to implement.

BRIEF SUMMARY

Aspects of the present disclosure include methods for driving display pixels. The method includes receiving a value of a display brightness parameter by a display driver integrated circuit (DDIC). The DDIC can determine a first value of a dynamic supply voltage parameter that is based on the value of the display brightness parameter. The DDIC may apply a first supply voltage that is based on the dynamic supply voltage, to one of a gate of a drive transistor of a light-emitting-diode circuit and a channel of the drive transistor over a first time interval. During the first time interval the drive transistor can be turned on during at least part of the first time interval. The DDIC may apply a first parking voltage that is based on the dynamic supply voltage parameter to an anode of a light-emitting diode of the light-emitting-diode circuit and to the channel of the drive transistor over a second time interval. The parking voltage may be below a threshold voltage of the light-emitting-diode. During the second time interval the drive transistor can be turned on during at least part of the second time interval.

Another aspect of the present disclosure includes a system comprising one or more processors and a non-transitory computer-readable media that includes instructions that when executed by the one or more processors, cause the one or more processors to perform methods described above.

Another aspects of the present disclosure include a non-transitory computer-readable media that includes instructions that when executed by one or more processors, cause the one or more processors to perform the methods described above.

A better understanding of the nature and advantages of embodiments of the present disclosure may be gained with reference to the following detailed description and the accompanying drawings.

DETAILED DESCRIPTION

Figure 1:
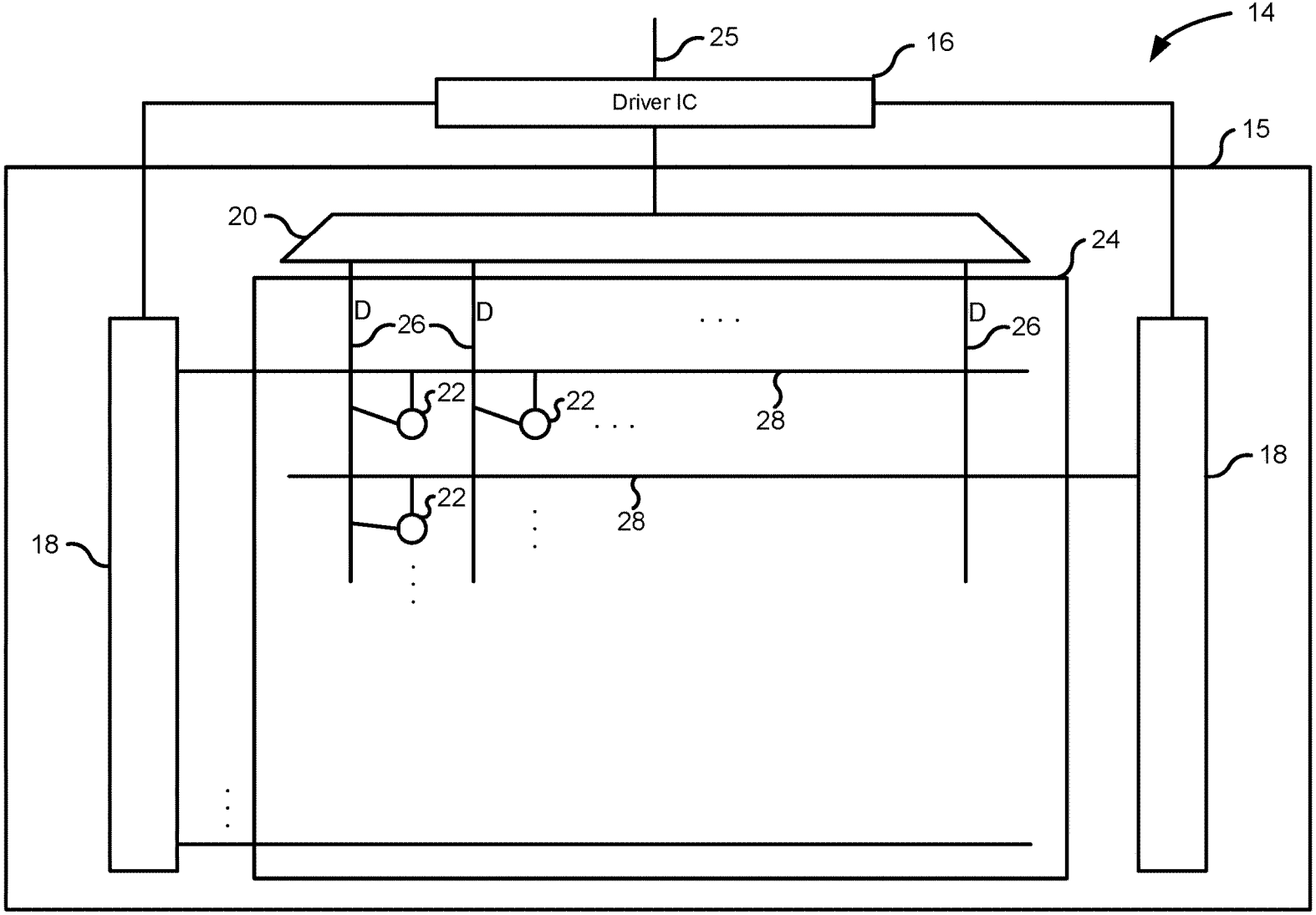
FIG. 1 illustrates a circuit diagram of an illustrative display including an array of pixel circuits according to at least one aspect of the present disclosure.

A display in an electronic device may include driver circuitry for displaying images on an array of display pixels. As shown in FIG. 1, display 14 may include display driver integrated circuit (DDIC) 16 and a display panel 15. Panel 15 may have one or more layers such as substrate 24. Substrate 24 may be formed from planar rectangular layers of material such as planar glass layers and may support an array of display pixels 22 for displaying images for a user. The array of display pixels 22 may be formed from rows and columns of display pixel structures on substrate 24. These structures may include a backplane of thin-film transistors (TFTs) such as polysilicon TFTs, amorphous silicon TFTs, semiconducting oxide TFTs, etc. There may be any number of rows and columns in the array of display pixels 22 that is suitable for the desired application (e.g., ten or more, one hundred or more, or one thousand or more).

Display driver integrated circuit 16 may be coupled to conductive paths such as metal traces on substrate 24 using solder or conductive adhesive. Display driver integrated circuit 16 may transmit and/or receive data and control signals from control circuitry (e.g., a System-on-Chip or SoC) over path 25. Path 25 may be formed from traces on a flexible printed circuit or other cable. The system control circuitry may be located on a main logic board in an electronic device in which display 14 is being used. During operation, the control circuitry may supply display driver integrated circuit 16 with information on images to be displayed on display 14 via path 25. To display the images on display pixels 22, display driver integrated circuit 16 may supply clock signals and other control signals to display driver circuitry such as row driver circuitry 18 and column driver circuitry 20. Row driver circuitry 18 and/or column driver circuitry 20 may be formed from one or more integrated circuits and/or one or more TFT circuits in a backplane on substrate 24.

Row driver circuitry 18 may be located on the left and right edges of panel 15, on only a single edge of panel 15, or elsewhere in panel 15. During operation, row driver circuitry 18 may provide row control signals on horizontal lines 28. Row driver circuitry 18 may be referred to as scan line driver circuitry. Row driver circuitry 18 may also be used to provide other row control signals.

Column driver circuitry 20 may be used to provide data signals D from display driver integrated circuit 16 onto a plurality of corresponding vertical lines 26. Column driver circuitry 20 may sometimes be referred to as data line driver circuitry or source driver circuitry. Vertical lines 26 may be referred to as data lines. During compensation operations, column driver circuitry 20 may use paths such as vertical lines 26 to supply a reference voltage. During programming operations, display data can be loaded into display pixels 22 using vertical lines 26.

Each data line 26 is associated with a respective column of display pixels 22. Sets of horizontal signal lines 28 run horizontally through panel 15. Power supply paths and other lines may also supply signals to pixels 22. Each set of horizontal signal lines 28 is associated with a respective row of display pixels 22. The number of horizontal signal lines in each row may be determined by the number of transistors in the display pixels 22 that are being controlled independently by the horizontal signal lines. Display pixels of different configurations may be operated by different numbers of control lines, data lines, power supply lines, etc.

Row driver circuitry 18 may assert control signals on row lines 28 in panel 15. For example, driver circuitry 18 may receive clock signals and other control signals from display driver integrated circuit 16 and, in response to the received signals, may assert control signals in each row of display pixels 22. Rows of display pixels 22 may be processed in sequence or in parallel. For instance, in sequence, processing for each frame of image data may start at the top of the array of display pixels and end at the bottom of the array or start at the bottom of the array of display pixels and end at the top of the array. While the scan lines in a row are being asserted, the control signals and data signals that are provided to column driver circuitry 20 can be demultiplexed to drive associated data signals D onto data lines 26 such that the display pixels in the row may be programmed with the display data appearing on the data lines D. The display pixels can then display the loaded display data.

Figure 2:
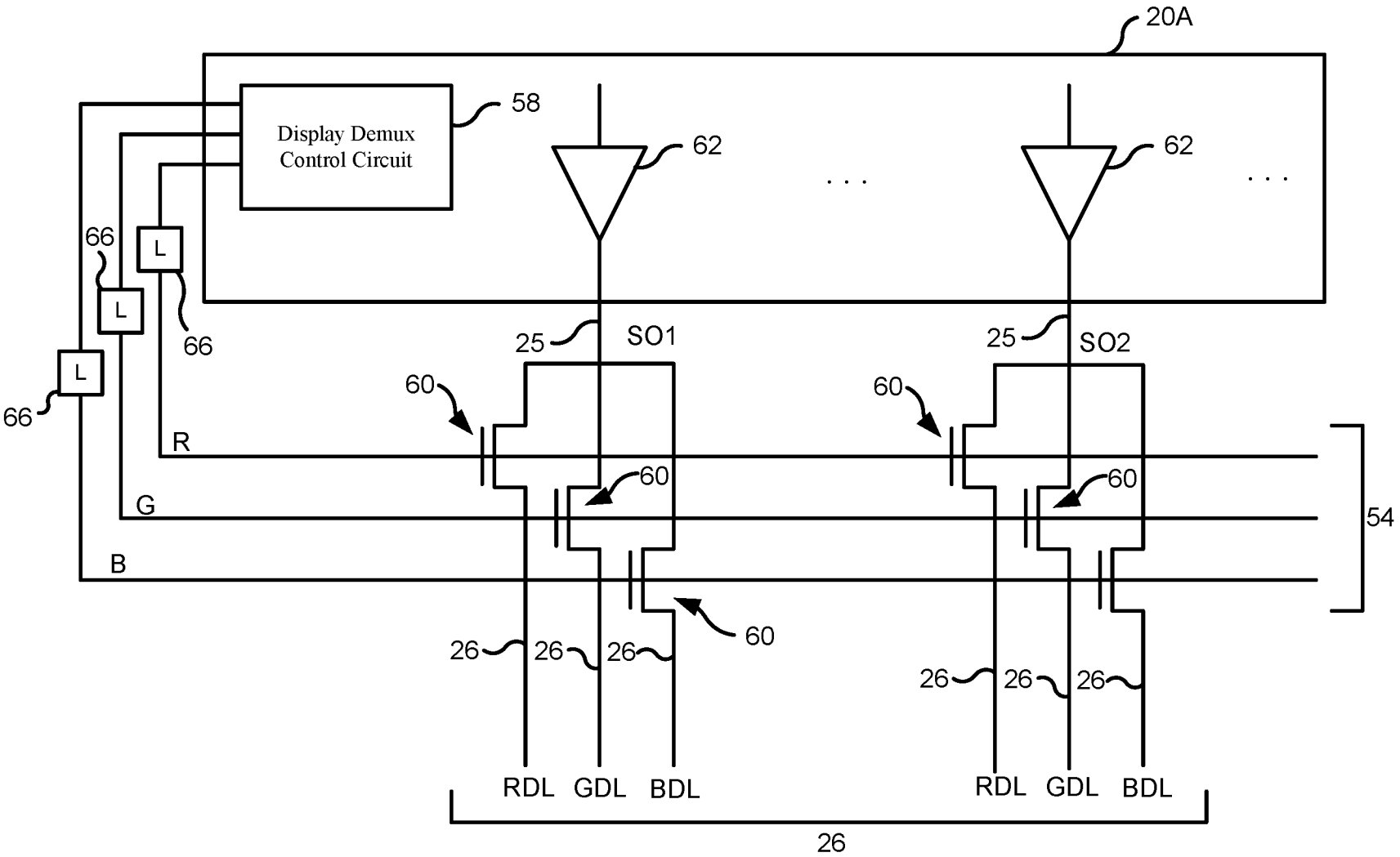
FIG. 2 is a circuit diagram of an display driver circuitry according to at least one aspect of the present disclosure.

FIG. 2 is a circuit diagram of an example of display driver circuitry according to at least one aspect of the present disclosure. In this example, an implementation 20A of column driver circuitry 20 may output data line signals that contain grayscale information for multiple color channels, such as red, green, and blue channels. Demultiplexing circuitry 54 may demultiplex the data line signal into respective R, G, and B data line signals on respective implementations RDL, GDL, and BDL of data lines 26. Display demultiplexer control circuit 58 in column circuitry 20 may be used to supply data line demultiplexer control signals for red, green, and blue to the gate terminals of demultiplexing transistors 60. Data line drivers 62 may produce data line output signals SO1, SO2, etc. on data line paths 25. The output signals may contain analog pixel data for image pixels of all three colors (i.e., red, blue, and green). The control signals that are applied to the gates of demultiplexing transistors 60 turn transistors 60 on and off in a pattern that routes red channel information from the source output signals to red data lines RDL, that routes green channel information from the source output signals to green data lines GDL, and that routes blue channel information from the source output signals to blue data lines BDL.

Loading circuits 66 may be implemented using one or more discrete components (e.g., capacitors, inductors, and resistors) that are interposed within lines 54 or may be implemented in a distributed fashion using some or all of the structures that form lines 54. Loading circuits 66 and/or circuitry in column driver circuitry 20A may be used to control the shape of the demultiplexing control signals R, G, and B. Signal shaping techniques such as these may be used to smooth display control signal pulses such as the demultiplexer control signal pulses and thereby reduce harmonic signal production and radio-frequency interference.

In an organic light-emitting diode display such as display 14, each display pixel may include a respective organic light-emitting diode for emitting light. A drive transistor can control an amount of light output by the organic light-emitting diode. Control circuitry in the display pixel may be configured to perform threshold voltage compensation operations (e.g., under the control of display driver IC 16). The threshold voltage compensation operations may ensure that the size of the output signal from the organic light-emitting diode is proportional to the magnitude of the data signal loaded into the display pixel while being independent of the threshold voltage of the drive transistor.

Figure 3:
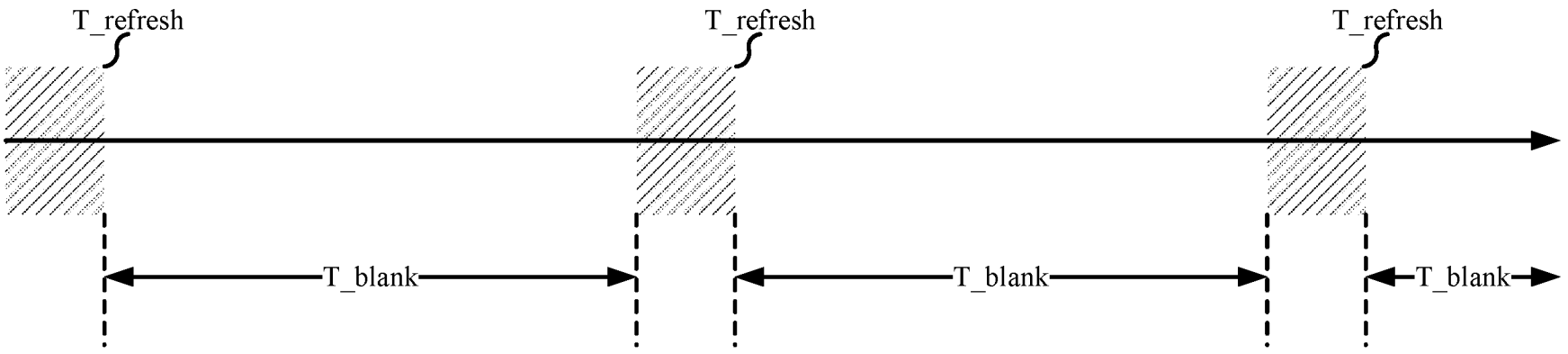
FIG. 3 is a diagram of a low refresh rate display driving scheme according to at least one aspect of the present disclosure.

FIG. 3 is a diagram of a timing scheme for low refresh rate display driving according to at least one aspect of the present disclosure. Display 14 may be configured to support a low refresh rate operation. For instance, the display may operate with a reference rate of 1 Hz, 2 Hz, or any other low rate. Operating display 14 using a low refresh rate may be suitable for applications outputting content that is static or nearly static (e.g., a display of icons for selection, a watch or clock face, a background image, etc.) and/or for applications that require minimal power consumption. Display 14 may alternate between a data refresh interval (e.g., T_refresh) and an extended vertical blanking interval (e.g., T_blank). For instance, each T_refresh may be approximately 16.67 milliseconds (ms) in accordance with a 60 Hz data refresh operation, whereas each T_blank may be approximately 1 second so that the overall refresh rate may be lowered to 1 Hz. T_blank can be adjusted to tune the overall refresh rate of display 14. For instance, if T_blank is tuned to half a second, the overall refresh rate would be increased to approximately 2 Hz. T_blank may be a multiple of T_refresh such as, for example, at least two times, at least ten times, at least 30 times, or at least 60 times longer in duration than T_refresh.

Figure 4:
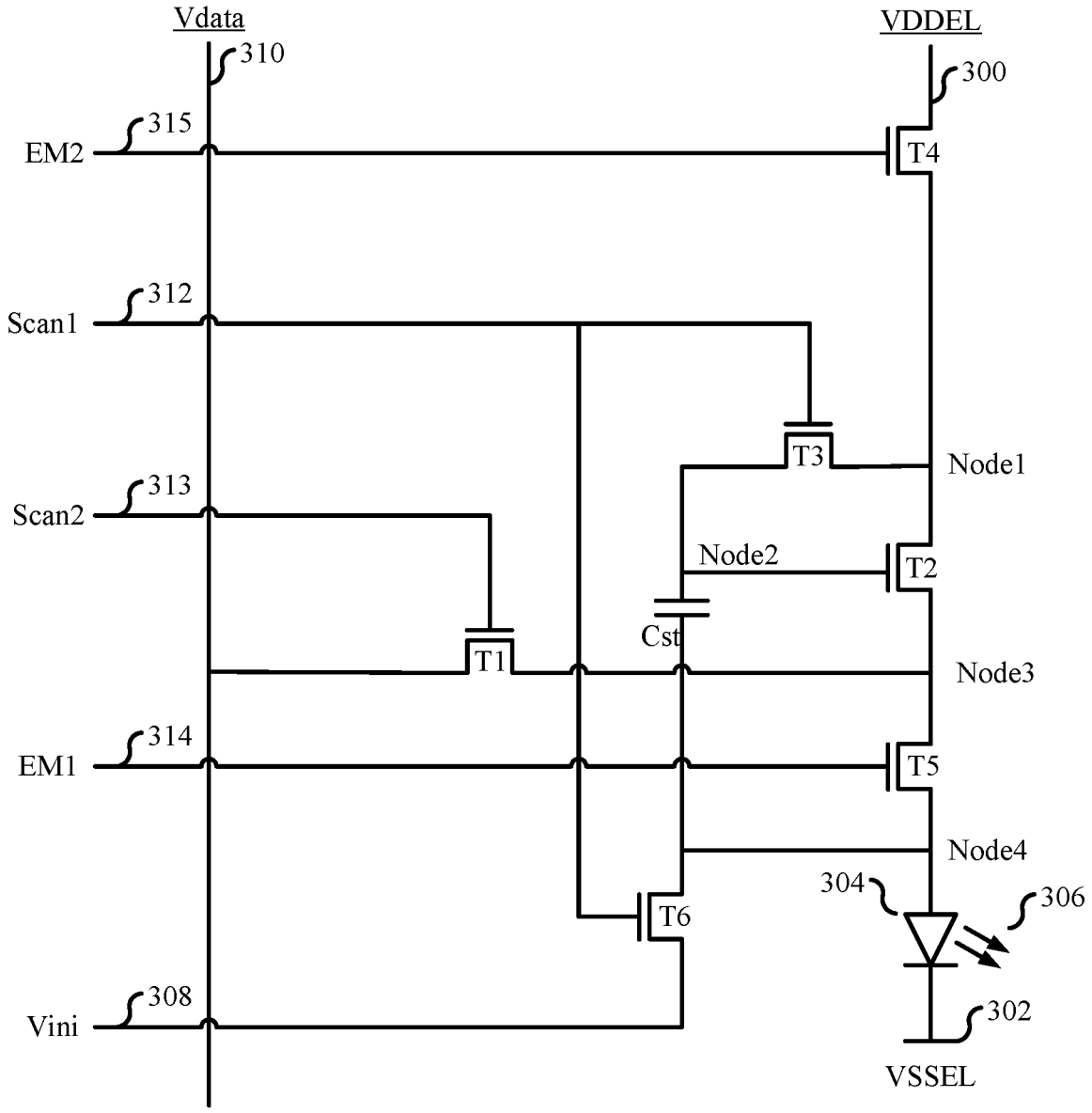
FIG. 4 illustrates a circuit diagram of a light-emitting diode display pixel according to at least one aspect of the disclosure.

FIG. 4 illustrates a circuit diagram of an light-emitting diode pixel circuit according to at least one aspect of the disclosure. Display pixel 22 may include a storage capacitor Cst and transistors such as n-type (i.e., n-channel) transistors T1, T2, T3, T4, T5, and T6 (also called a 6T1C pixel circuit). The transistors of pixel 22 may be TFTs formed from a semiconductor such as silicon (e.g., polysilicon deposited using a low temperature process sometimes referred to low-temperature polysilicon or LTPS) semiconducting oxide (e.g., indium gallium zinc oxide (IGZO)), etc.

In some instances, transistor T3 may be implemented as a semiconducting-oxide transistor while remaining transistors T1, T2, and T4-T6 may be silicon transistors (e.g., LPTS TFTs). Semiconducting-oxide transistors may exhibit lower leakage than silicon transistors, and a backplane whose pixel circuits include both LTPS TFTs and semiconducting-oxide TFTs may be referred to as a low-temperature polycrystalline oxide (LTPO) backplane. Implementing T3 as a semiconducting-oxide transistor can contribute to the reduction in flicker at low refresh rates by, for example, preventing current from leaking through T3. In other instances, transistors T3 and T6 may be implemented as semiconducting-oxide transistors and while remaining transistors T1, T2, T4, and T5 may be silicon transistors. Since both transistors T3 and T6 are controlled by signal Scan1, implementing both T3 and T6 as the same transistor type may simplify fabrication.

In still yet other instances, transistors T3, T6, and also T2 may be implemented as semiconducting-oxide transistors while remaining transistors T1, T4, and T5 may be silicon transistors. Transistor T2 may be a drive transistor having a threshold voltage that is critical to the emission current of pixel 22. The threshold voltage (Vth) of the drive transistor may experience hysteresis, which may be reduced by forming the drive transistor as a top-gate semiconducting-oxide transistor, for example, since a top-gate IGZO transistor may experience less Vth hysteresis than a silicon transistor. Any or all of transistors T1-T6 may be semiconducting-oxide transistors. Moreover, any one or more of transistors T1-T6 may be p-type (i.e., p-channel) TFTs or n-type (i.e., n-channel) TFTs.

Display pixel 22 may include light-emitting diode 304. A positive power supply voltage VDDEL may be supplied to positive power supply terminal 300 and a ground power supply voltage VSSEL (e.g., 0 volts or other suitable voltage) may be supplied to ground power supply terminal 302. The state of drive transistor T2 can control an amount of current flowing from terminal 300 to terminal 302 through diode 304, and therefore the amount of emitted light 306 from display pixel 22. Diode 304 may have an associated parasitic capacitance (not shown).

Terminal 308 may be used to supply an initialization voltage Vini to assist in turning off diode 304 when diode 304 is not in use. Vini may be, for example, a negative voltage such as −1 V, −2 V, or other suitable voltage. Control signals from display driver circuitry (e.g., DDIC 16, row driver circuitry 18, and/or column driver circuitry 20) are supplied to control terminals such as terminals 312, 313, 314, and 315. Terminals 312 and 313 may serve respectively as first and second scan control terminals, whereas terminals 314 and 315 may serve respectively as first and second emission control terminals. Scan control signals Scan1 and Scan2 may be applied to scan terminals 312 and 313, respectively. Emission control signals EM1 and EM2 may be supplied to terminals 314 and 315, respectively. A data input terminal such as Vdata 310 can be coupled to a respective data line such as data line 26 of FIG. 1 for receiving image data for display pixel 22.

Transistors T4, T2, T5, and diode 304 may be coupled in series between power supply terminals 300 and 302. Transistor T4 may have a drain terminal that is coupled to positive power supply terminal 300, a gate terminal that receives emission control signal EM2, and a source terminal, labeled as Node1. The "source" and "drain" terminals are the opposite ends of the channel of the transistor; the terms "source" and "drain" are sometimes used interchangeably and therefore such terminals may be referred to herein as "source-drain" terminals. Drive transistor T2 may have a drain terminal that is coupled to Node1, a gate terminal labeled as Node2, and a source terminal labeled as Node3. Transistor T5 may have a drain terminal that is coupled to Node3, a gate terminal that receives emission control signal EM1, and a source terminal, labeled as Node4, that is coupled to ground power supply terminal 302 via diode 304.

Transistor T3, capacitor Cst, and transistor T6 may be coupled in series between Node1 and Vini voltage supply terminal 308. Transistor T3 may have a drain terminal that is coupled to Node1, a gate terminal that receives scan control signal Scan1, and a source terminal that is coupled to Node2. Storage capacitor Cst may have a first terminal that is coupled to Node2 and a second terminal that can be coupled to Node4. Transistor T6 may have a drain terminal that can be coupled to Node4, a gate terminal that receives scan control signal Scan1, and a source terminal that receives voltage Vini via terminal 308. Transistor T1 may have a drain terminal that can receive data line signal Vdata via terminal 310, a gate terminal that can receive scan control signal Scan2, and a source terminal that can be coupled to Node3. Signal EM2 may be asserted to activate transistor T4; signal EM1 may be asserted to activate transistor T5; signal Scan2 may be asserted to activate transistor T1; and signal Scan1 may be asserted to activate transistors T3 and T6.

Figure 5:
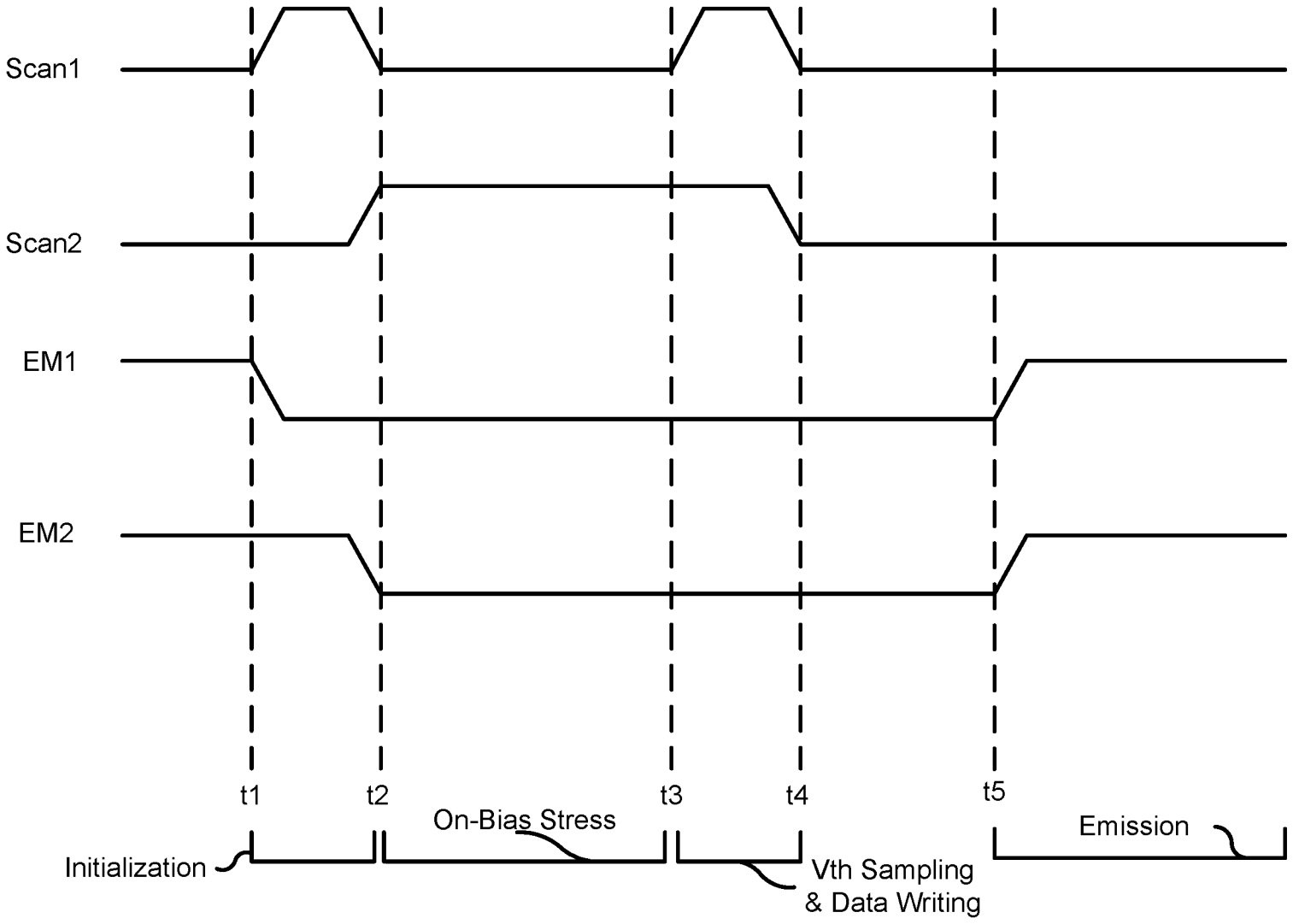
FIG. 5 is a timing diagram showing signals that may be applied to display pixel during four phases of the data refresh operation according to at least one aspect of the disclosure
Figure 6A:
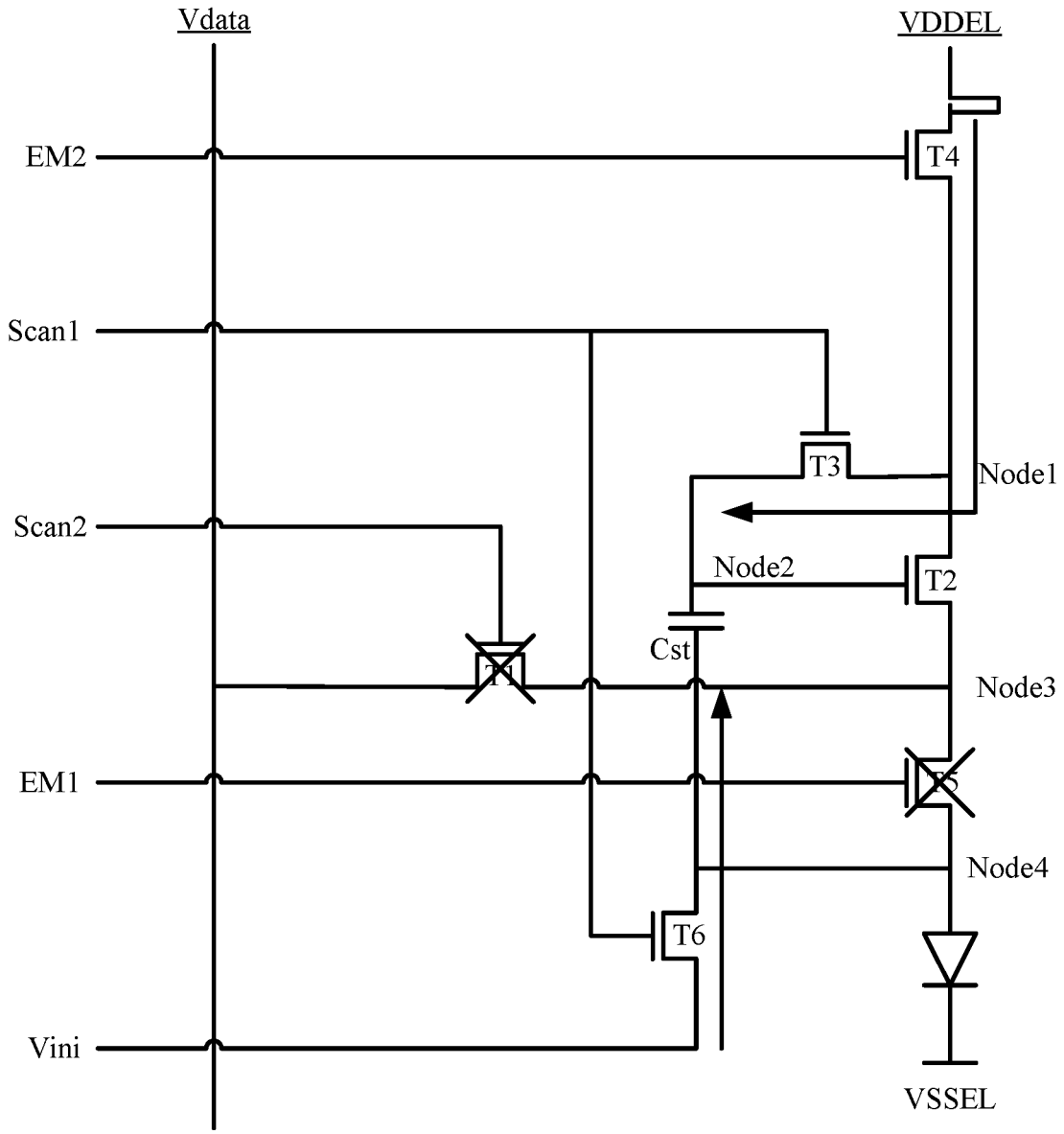
FIG. 6A illustrates a representation of the pixel circuit during an initialization phase according to at least one aspect of the disclosure.

FIG. 5 is a timing diagram showing signal waveforms that may be applied to display pixel 22 during four phases of the data refresh operation according to at least one aspect of the disclosure. During the data refresh period, display pixel 22 may be operated in at least four phases such as: (1) a reset/initialization phase, (2) an on-bias stress phase, (3) a threshold voltage sampling and data writing phase, and (4) an emission phase. At time t1, signal Scan1 may be pulsed high, signal EM1 may be pulled low, signal Scan2 may be low, and signal EM2 is high. Transistors T3, T4, and T6 (of FIG. 4) may be turned on since signals Scan1 and EM2 are high. The first terminal of capacitor Cst may be charged to VDDEL and the second terminal of capacitor Cst may be pulled down to Vini. During the initialization phase, the voltage across capacitor Cst is therefore reset to a predetermined voltage difference such as VDDEL-Vini. During this phase, Node3 may also be charged up to VDDEL-Vth, where Vth may be the threshold voltage of transistor T2. FIG. 6A illustrates the light-emitting diode pixel circuit with the given control signals during the initialization phase.

Figure 6B:
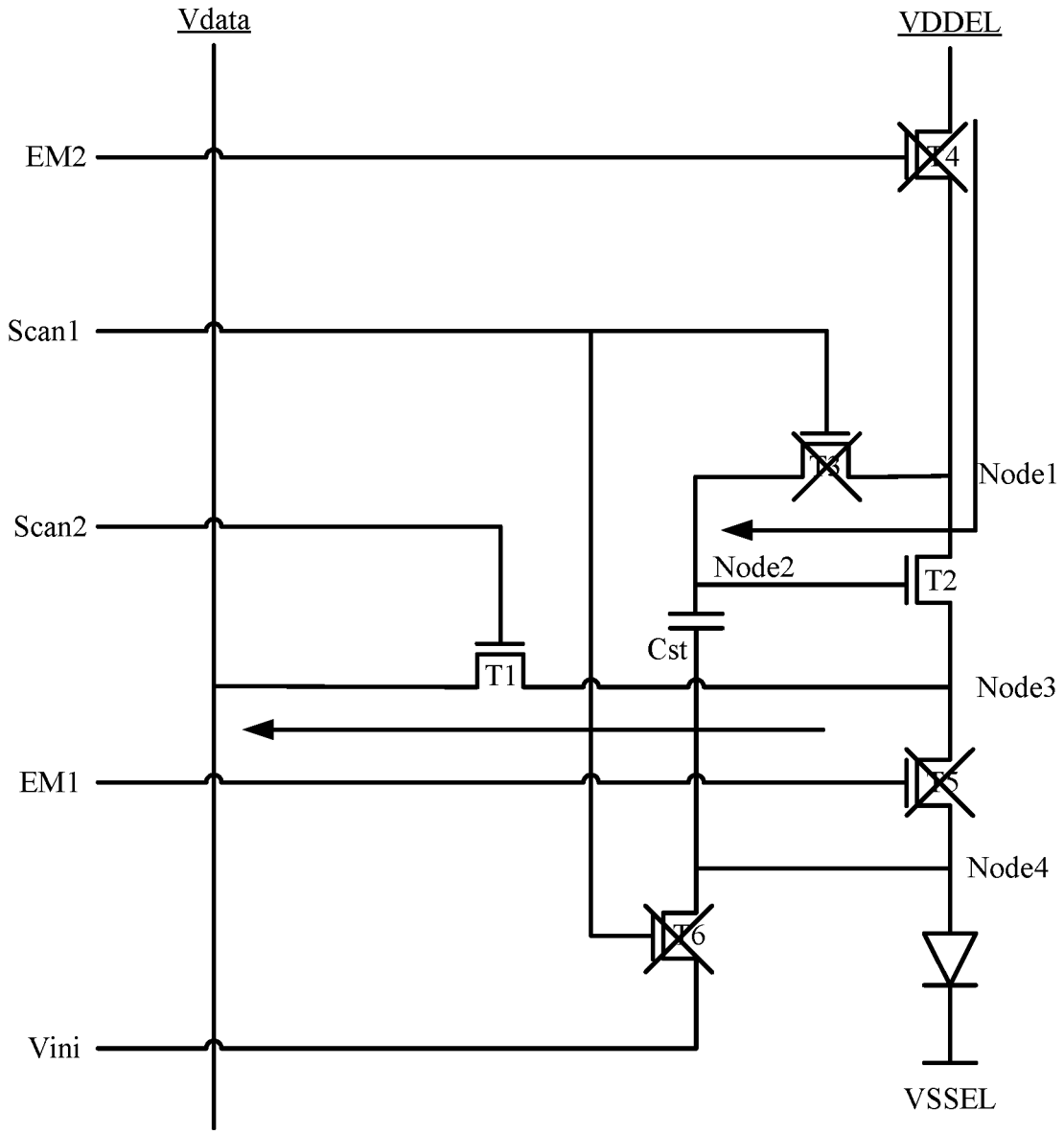
FIG. 6B illustrates a representation of the pixel circuit during an on-bias stress phase according to at least one aspect of the disclosure.

At time t2, signal Scan1 may be pulled low, signal Scan2 may be pulled high, and signal EM2 may be pulled low, which signifies the end of the initialization phase and the beginning of the on-bias stress phase. Only transistors T1 and T2 may be turned on, since signal Scan2 is high, and Node2 is charged to VDDEL during the initialization phase. In the on-bias stress phase, Node2 may remain at VDDEL and Node3 may be biased to Vdata using transistor T1, so that the gate-to-source voltage Vgs of transistor T2 may be VDDEL-Vdata. In such manner, Vdata can be at least partially applied to transistor T2 before any threshold voltage sampling. FIG. 6B illustrates the light-emitting diode pixel circuit with the given control signals during this phase.

Figure 6C:
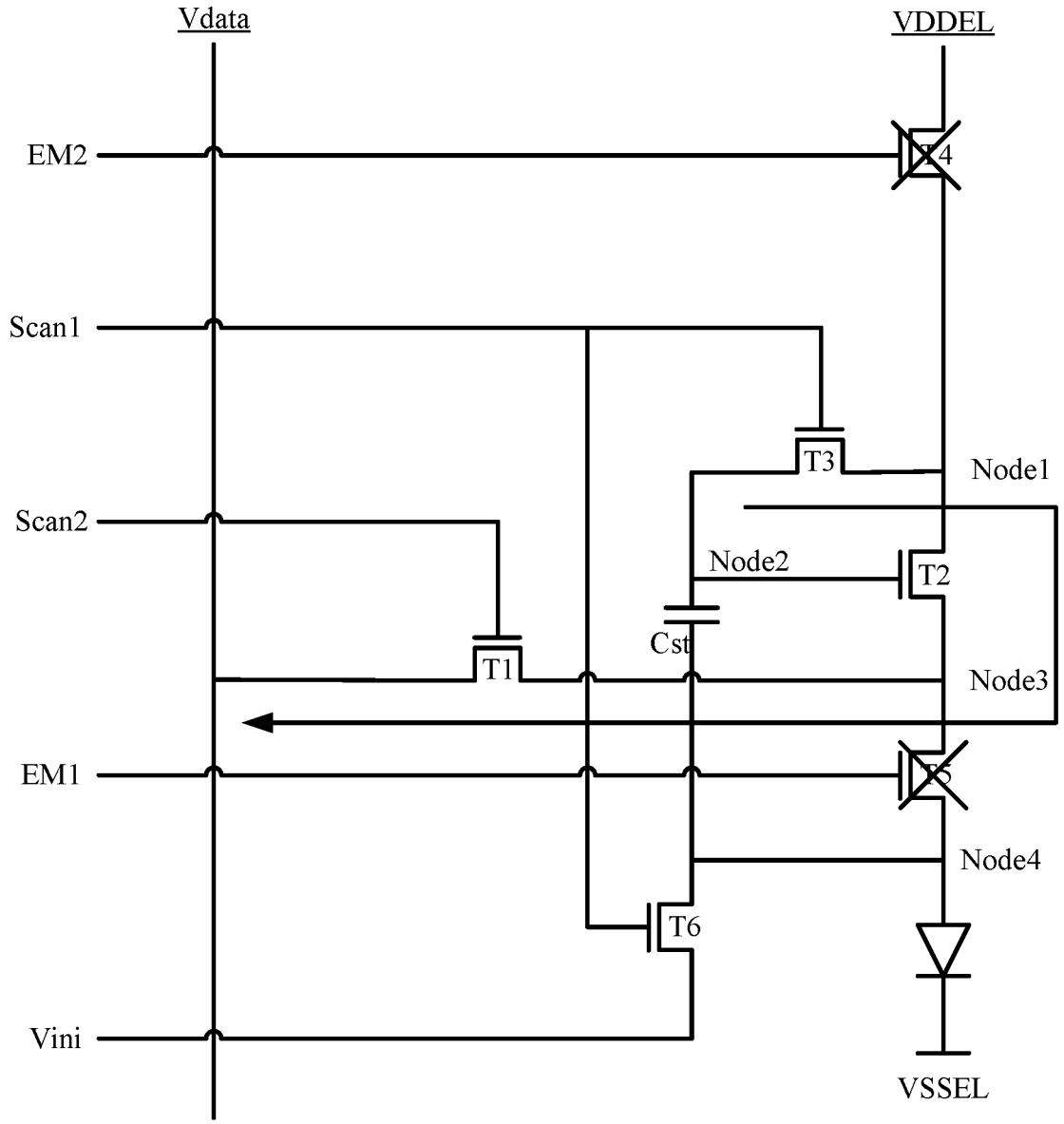
FIG. 6C illustrates a representation of the pixel circuit during an threshold voltage and data writing phase according to at least one aspect of the disclosure.

At time t3, signal Scan1 may be pulsed high, which signifies the end of the on-bias stress phase and the beginning of the threshold voltage Vth sampling and data writing phase. Transistors T1, T2, and T6 may be activated due to signals Scan1 and Scan2 being high. Node1 and Node2 may be pulled from VDDEL down to (Vdata+Vth), while Node3 may be set to Vdata. The gate-to-source voltage Vgs of transistor T2 may now be Vth (i.e., Vdata+Vth−Vdata). The resulting voltage across capacitor Cst may be Vdata+Vth−Vini. At time t4, both Scan1 and Scan2 may be pulled low, signifying the end of the threshold voltage and data writing phase. FIG. 6C illustrates the light-emitting diode pixel circuit with the given control signals during this phase.

Figure 6D:
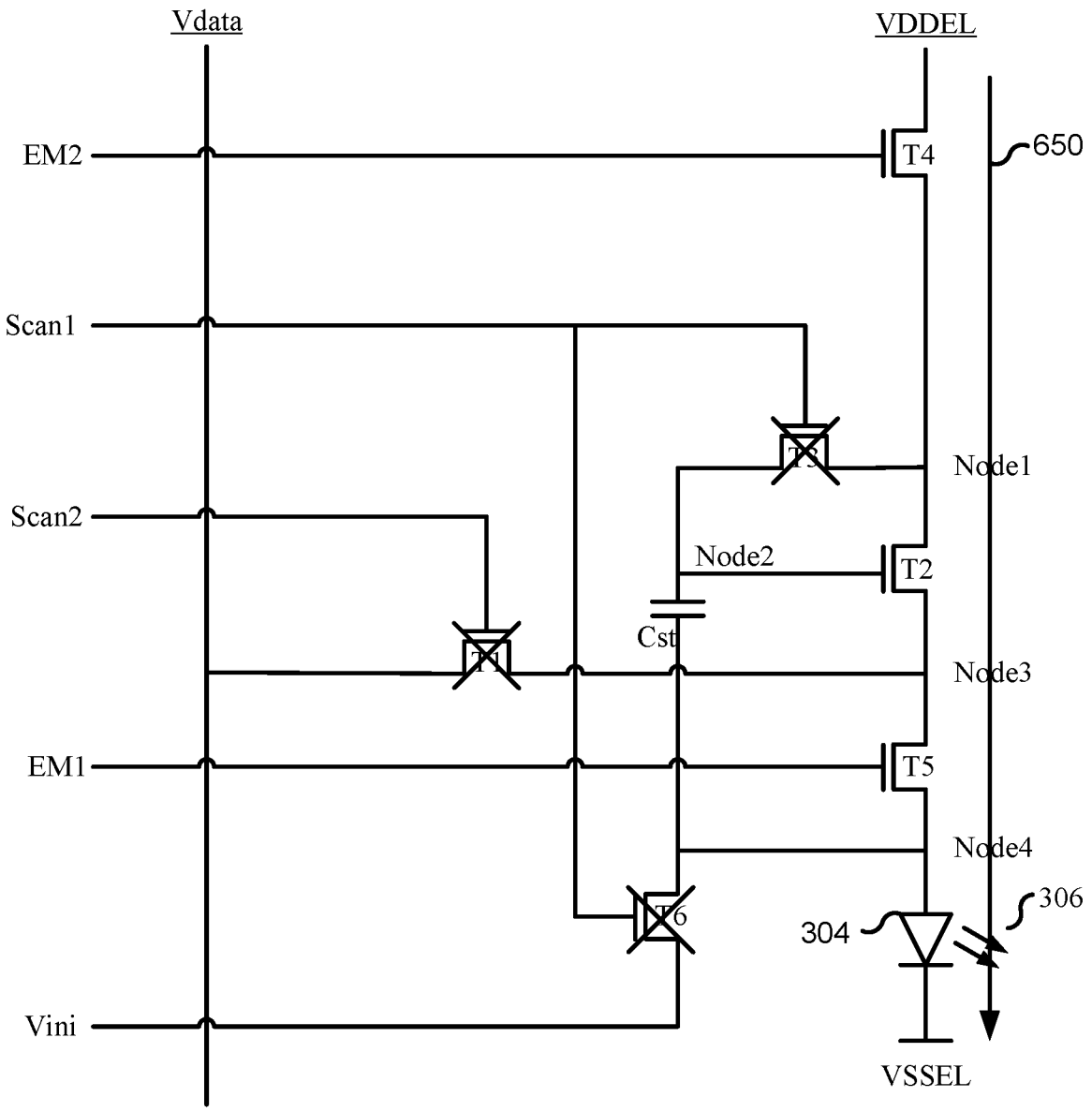
FIG. 6D illustrates a representation of the pixel circuit during an emission phase according to at least one aspect of the disclosure.

At time t5, signals EM1 and EM2 may be pulled high to signify the beginning of the emission phase. Transistors T2, T4, and T5 may be turned on to allow an emission current to flow through diode 304. The gate-to-source voltage Vgs of transistor T2 may be set by the voltage across storage capacitor Cst, which was set to Vdata+Vth−Vini during the threshold voltage Vth sampling and data writing phase (e.g., the interval between t3 and t4). Since emission current can be proportional to Vgs minus Vth, emission current may be independent of Vth, since Vth cancels out when subtracting Vth from Vdata+Vth−Vini. FIG. 6D illustrates the light-emitting diode pixel circuit with the given control signals during the emission phase.

In some instances, threshold voltage Vth can shift, such as when display 14 is transitioning from a black image to a white image or when transitioning from one gray level to another. The shifting in Vth, referred as thin-film transistor or TFT "hysteresis", can cause a reduction in luminance, also known as "first frame dimming". If no on-bias stress operation is performed before Vth sampling, the sampled Vth may deviate from the target curve by quite a large margin. By performing the on-bias stress, the sampled Vth can correspond to Vdata and will therefore be much closer to the target curve. Performing the on-bias stress phase to bias the Vgs of transistor T2 with Vdata before sampling Vth can therefore mitigate hysteresis and prevent first frame dimming.

Figure 7A:
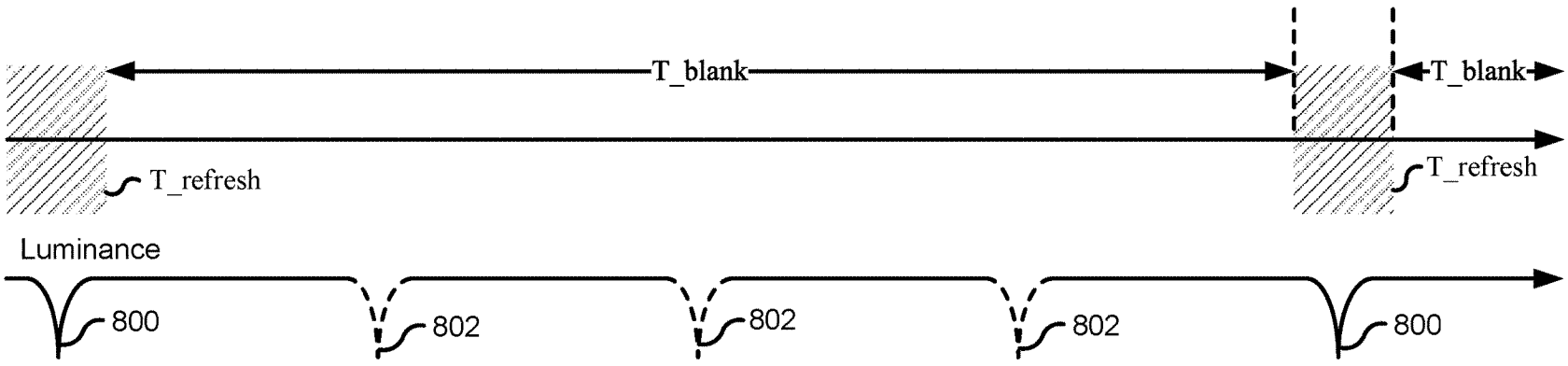
FIG. 7A illustrates a timing diagram showing how one or more anode reset operations performed during an extended blanking period according to at least one aspect of the disclosure.

FIG. 7A illustrates display luminance as a function of time according to at least one aspect of the disclosure. Operating display 14 under low refresh rates may cause the emission current to be toggled only during the data refresh periods. The luminance may experience dips 800 during data refresh periods T_refresh. The luminance dips 800 are caused by sequentially shutting off and then turning on transistor T4, such as during the four phases described above in connection with FIG. 5 above. Luminance dips 800 that occur at a frequency of 1 Hz may result in noticeable flicker to the user.

Figure 7B:
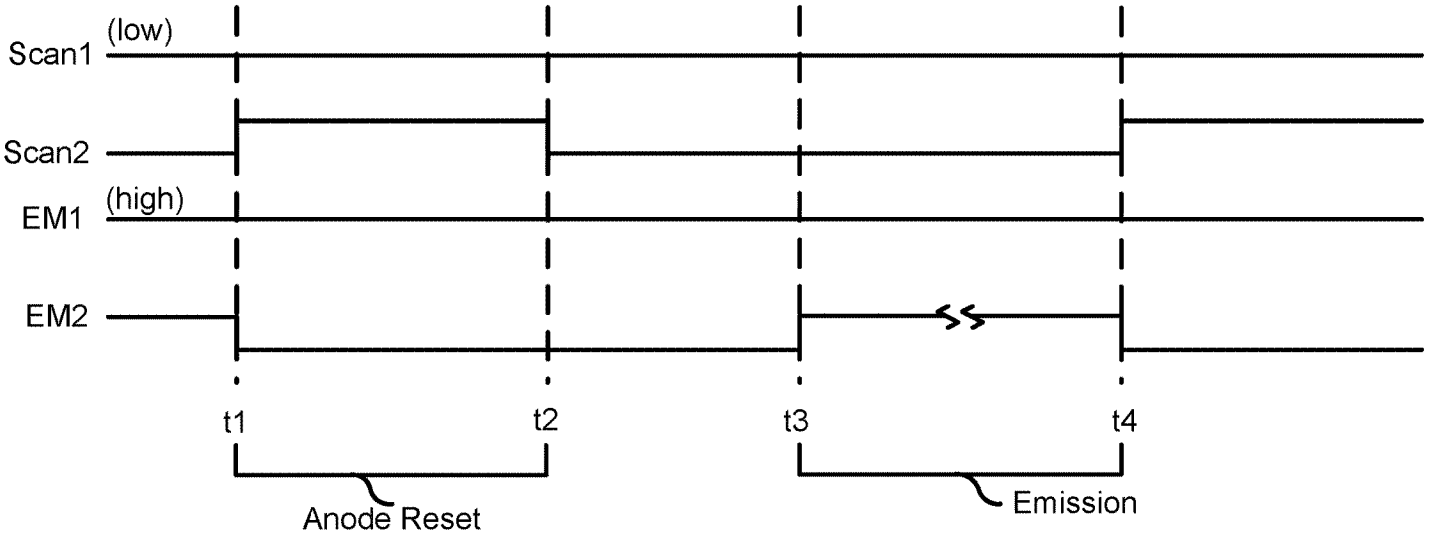
FIG. 7B illustrates a timing diagram showing the behavior of relevant signals during an anode reset operation according to at least one aspect of the disclosure.
Figure 8:
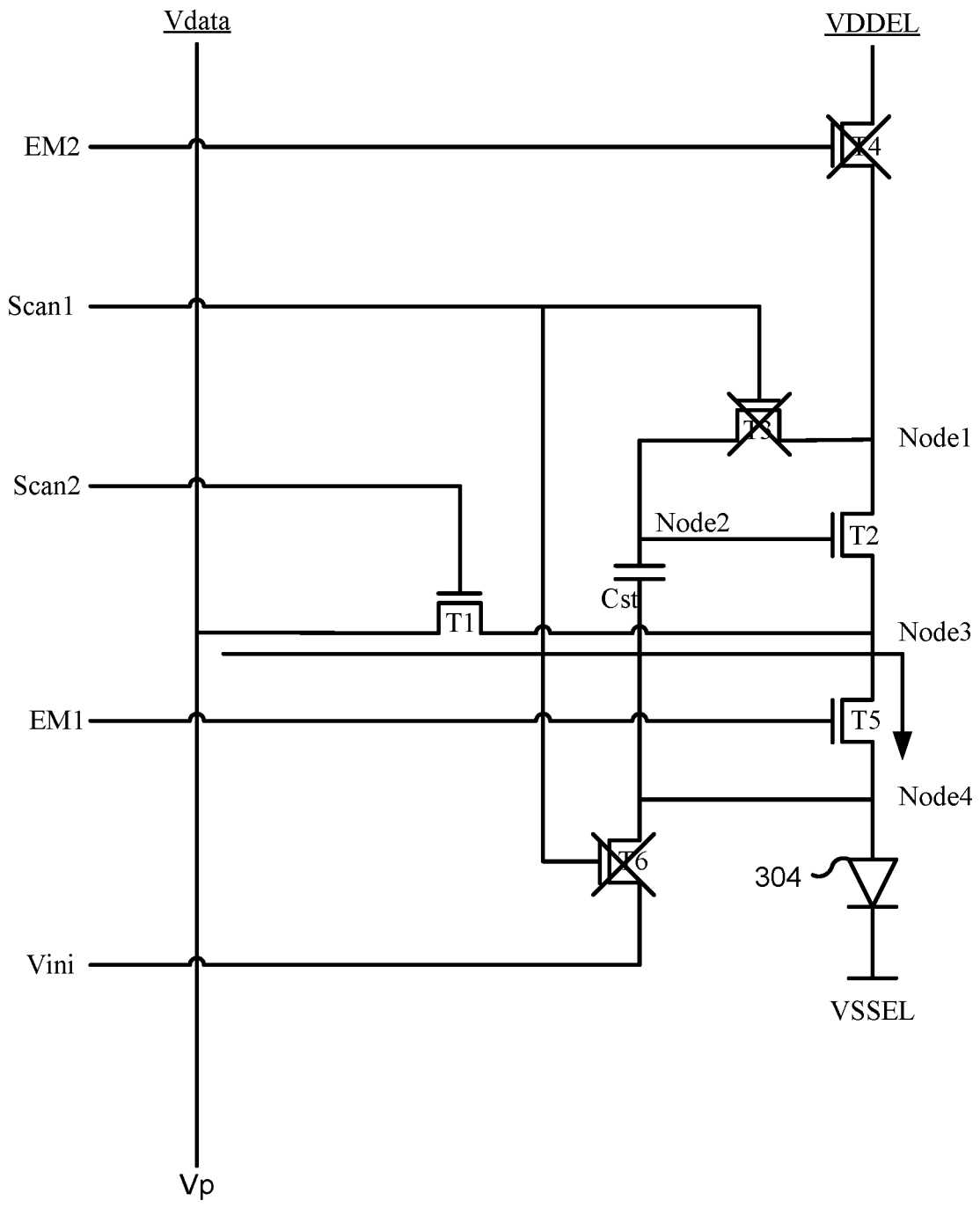
FIG. 8 illustrates a representation of the pixel circuit during an anode reset phase according to at least one aspect of the disclosure.

As shown in FIG. 7A, luminance dips 802 may be inserted during the vertical blanking period T_blank to reduce flicker. Though three luminance dips 802 during T_blank are depicted, any number of luminance dips may be performed. For instance, there may be at least 10 dips, at least 100 dips, or more than 100 dips may be produced during the extended blanking period T_blank. By artificially and intentionally generating luminance dips at a higher frequency than the refresh rate, the flickering may less noticeable to the human eye. Dips 802 during the blanking period may be produced, for example, by alternating between an anode reset phase and the emission phase. During anode reset, as shown in FIG. 7B, signal Scan2 may be pulsed high, signal EM2 may be pulled low, signal Scan1 may be low, and signal EM1 may be high. Transistors T1 and T5 may be turned on, causing Node4, which is the anode of diode 304, to be reset to a parking voltage Vp. As shown in FIG. 8, the data line may be "parked" at voltage Vp during the blanking interval. Voltage Vp may be, for example, equal to any of VSSEL, 2V, or any voltage there between. It may be desirable for the parking voltage Vp to be below a threshold voltage of LED 304 (e.g., to reset a voltage that may arise across a parasitic capacitance of the LED). Source driver 62 may be deactivated during this time. Transistor T4 may be deactivated such that there may not be any emission current flowing during the anode reset phase. At time t2, signal Scan2 is driven (pulled) low, which marks the end of the anode reset phase. FIG. 8 illustrates the light-emitting diode pixel circuit with the given control signals during the anode reset phase.

After the expiration of the anode reset phase and at initialization of the emission phase, signal EM2 may be driven high, which can activate transistor T4, T2, and T5 such that emission current may flow through diode 304. Emission current may continue to flow until the next anode reset phase. In some instances, the emission phase may be longer than the anode reset phase. In other instances, the emission phase may be shorter than the anode reset phase. The anode reset operation can be performed to produce as many luminance dips 802 during the vertical blanking period as may help reduce or minimize low refresh rate flicker.

Figure 9:
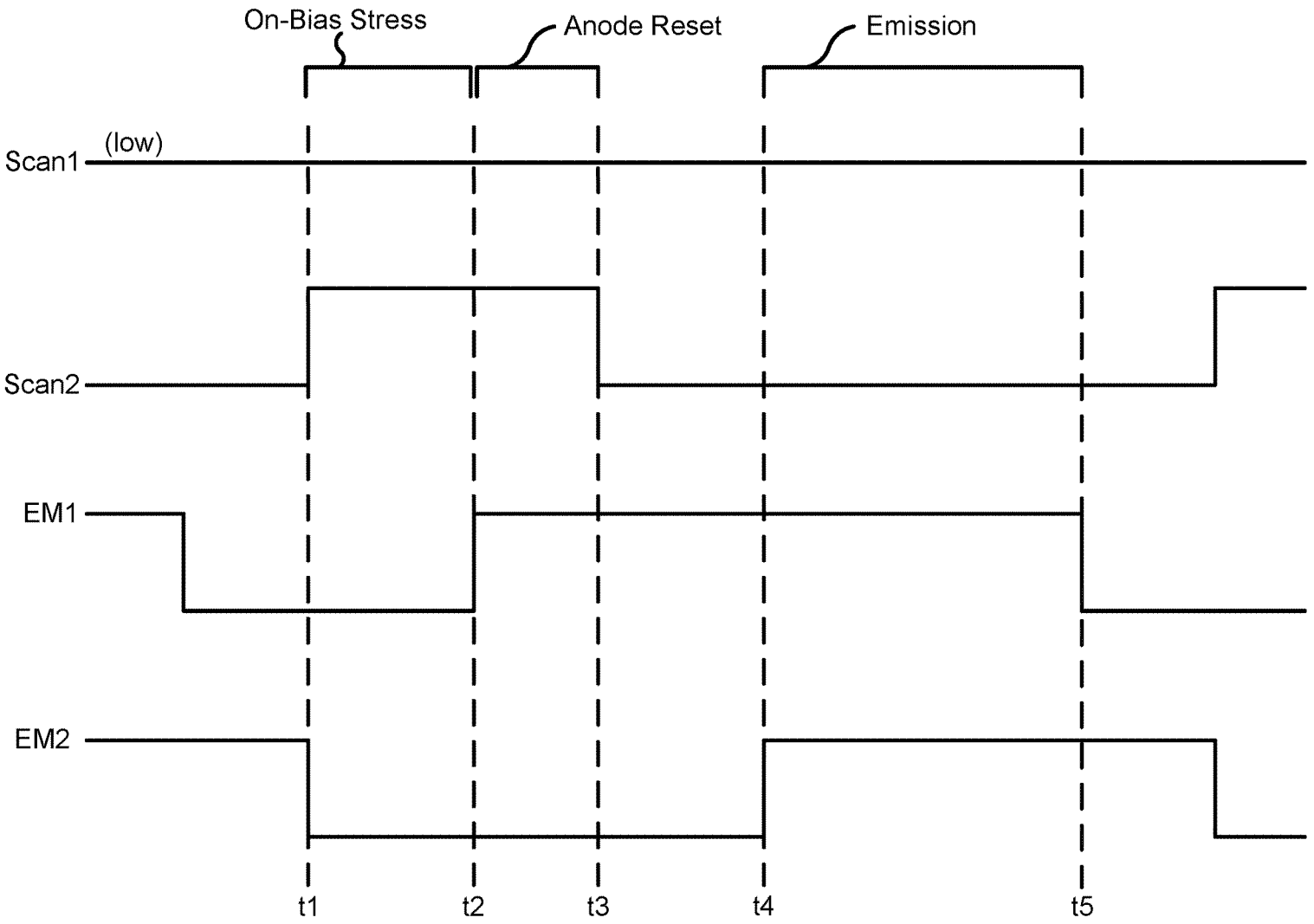
FIG. 9 illustrates a timing diagram showing how on-bias stress may be applied prior to an anode reset during the extended blanking period according to at least one aspect of the disclosure.

FIG. 9 is a timing diagram illustrating an on-bias stress phase inserted before the anode reset phase during the vertical blanking period, according to at least one aspect of the disclosure. Signal EM1 may be low prior to time t1, which prepares pixel 22 for the on-bias stress. At time t1, signal Scan2 may be pulled high to mark the beginning of the on-bias stress phase. The pixel 22 at the time interval t1-t2 may be as shown in FIG. 6B, in which transistors T1 and T2 may be turned on. Node3 may be biased to Vdata using transistor T1. At time t2, signal EM1 is driven high to turn on transistor T5, which marks the end of the on-bias stress phase and the beginning of the anode reset phase. FIG. 8 illustrates the configuration of pixel 22 during the time interval t2-t3 in which transistors T1 and T5 are both on. The anode terminal Node4 of diode 304 can be reset to Vdata (which carries the parking voltage Vp during this period). At time t3, signal Scan2 can be pulled low. From time t4-t5, emission signals EM1 and EM2 are both high to allow the emission current to flow. In general, an on-bias stress phase may accompany and immediately precede any number of anode reset operations during the extended vertical blanking period to help replicate and mirror the on-bias stress throughout the operation of display 14. During the emission phase, the control signals and pixel 22 may appear in the same manner as depicted in FIG. 6D.

In some instances, multiple data refreshes and multiple anode reset operations may be performed when display 14 is transitioning from a black frame to a white frame or in general, when display 14 is transitioning from one gray level to another. For instance, at least two data refreshes (multi refresh) can be performed at 30 Hz, during each of which the four phases of FIGS. 5-6 can be performed. Performing more than one data refresh enables enhanced Vth tracking and therefore a better luminance response that minimizes first frame dimming.

In addition to the multi-refresh operation, additional anode reset and on-bias stress operations may be performed at 60 Hz. The anode reset rate may be greater than the multi-refresh rate. Vth tracking may be further improved by the additional on-bias stress applied, which may help with faster Vth settling. The luminance may be closer to the target level, thereby providing better first-frame performance. The anode reset can be any integer multiple of the data refresh rate such as, but not limited to, at least four times greater, at least eight times greater, at least ten times, or the like. Increasing the frequency of on-bias stress phases between each successive data refresh phase may provide even faster Vth settling and further improve first-frame performance.

During the emission phase, the brightness of display 14 can be adjusted via pulse width modulation. In conventional display driving schemes, signal EM2 can be pulsed repeatedly and has a duty cycle that is adjustable to control the brightness, and signal EM1 may remain high without toggling. If signal EM1 remains high, activating transistor t5, it is possible for excess current to leak through transistor T5, which results in a poor black level. In order to mitigate this issue, signals EM1 and EM2 may be toggled simultaneously and in synchronization with one another.

Figure 10:
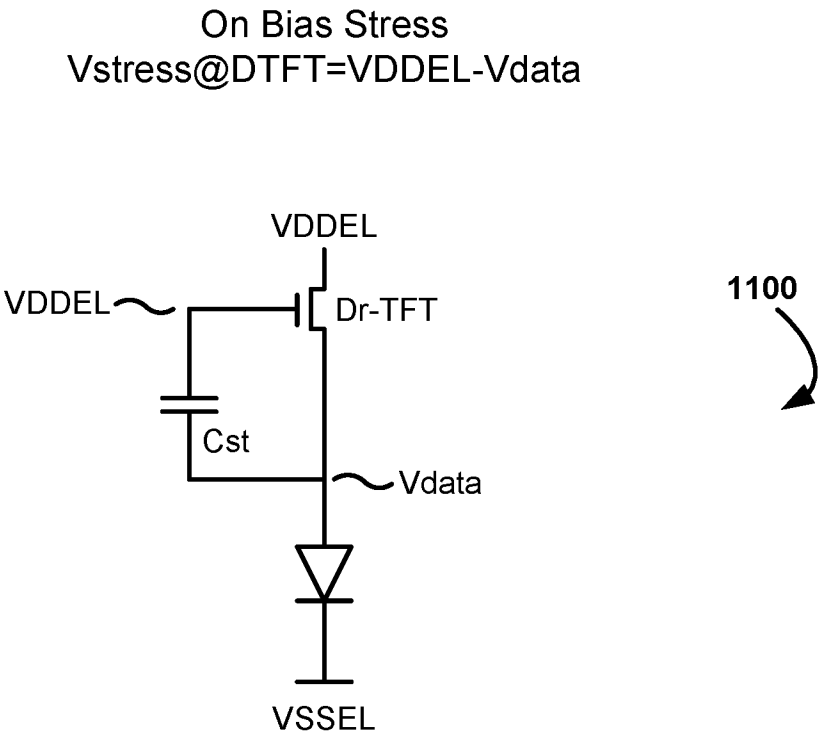
FIG. 10 illustrates a portion of a N-type transistor pixel circuit during on-bias stress (OBS) according to at least one aspect of the disclosure.

FIG. 10 is a timing diagram illustrating EM1 and EM2 pulses according to at least one aspect of the disclosure, in which EM1 and EM2 may have the same duty cycle and be in-phase with each other. Driving EM1 low at the same time as EM2 turns off transistor T5, thereby disconnecting the leaky current path. In other words, there is no direct current path from Node1 to the diode when both EM1 and EM2 are both low. The number of pulses and the pulse width can be tuned to output a desired luminance level of the display.

Figure 11:
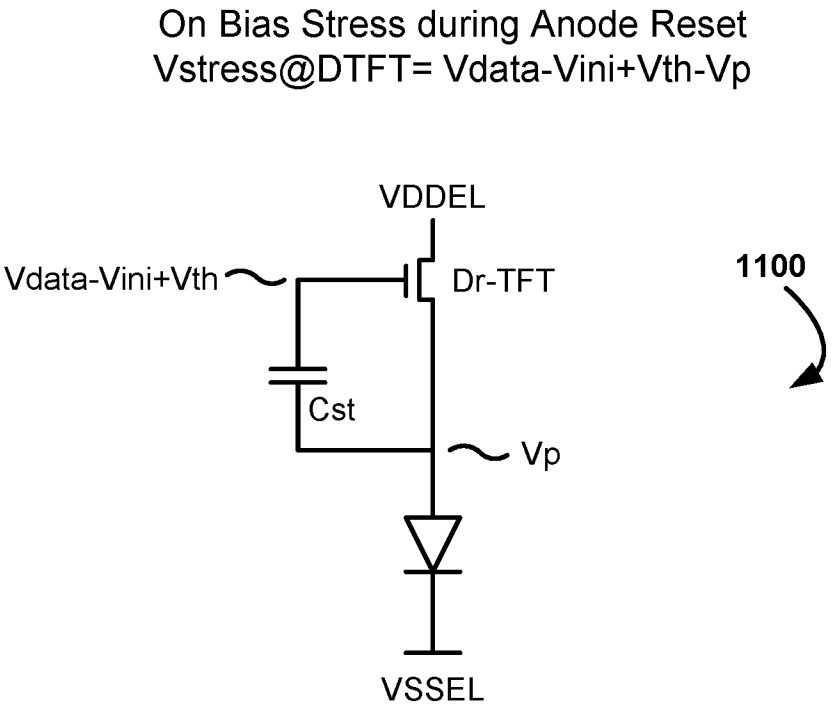
FIG. 11 illustrates a portion of a N-type transistor pixel circuit during on-bias stress during anode reset (OBSDAR) according to at least one aspect of the disclosure.

During an anode reset phase, an on-bias stress may be applied to the drive transistor by virtue of the sampled data signal being applied to the gate and the parking voltage Vp being applied to the channel. FIG. 11 illustrates a portion of a N-type transistor pixel circuit during an on-bias stress phase (left) and during an on-bias stress during anode reset phase (right) according to at least one aspect of the disclosure. As described above, an on-bias stress operation may be performed in a pixel circuit as shown in FIG. 4 by EM1, EM2, and Scan1 being driven low and Scan2 being driven high. During a preceding initialization phase, VDDEL may be applied to a terminal of the storage capacitor Cst such that at the immediate beginning of the on-bias stress phase, this terminal is charged to VDDEL. The voltage at this terminal may stay the same or may decrease during on-bias stress. During the on-bias stress operation, Vdata may be applied to the source terminal of the drive transistor, and the gate-to-source voltage Vgs may be equal to VDDEL-Vdata.

On-bias stress during the anode reset phase (as shown on the right side of FIG. 11) may be performed in a pixel circuit as shown in FIG. 4 by EM2 and Scan1 being driven low and EM1 and Scan2 being driven high. In this configuration, the parking voltage Vp may be applied to the anode of the light-emitting diode and to the channel of the drive transistor. In some instances (e.g., to ease fabrication of the pixel circuit), the parking voltage may be carried by the Vdata control signal path during the blanking period. The voltage at the gate of the drive transistor during the on-bias stress during anode reset phase may be Vdata−Vini+Vth, and the gate-to-source voltage Vgs may be equal to Vdata−Vini−Vth−Vp.

It may be desirable to vary VDDEL over time: for example, to save power. Reducing power consumption may be especially desirable, for example, in a portable device such as a cellular telephone or wearable device (e.g., a watch). It may be desirable to adjust VDDEL dynamically according to, for example, a desired maximum display brightness level or 'display brightness value' (DBV) for the frame (i.e., the brightness that results when all pixels of the display are fully lit during the frame). The DBV may be a digital quantity having a range of, for example, 0 to 255, and each value of the DBV may correspond to an amount of light output by the display as measured in, e.g., nits (cd/m$^2$). It may be desirable to vary the DBV over time (e.g., from one frame to the next) according to, for example, an ambient light level as indicated by one or more light sensors of the device. For example, it may be desirable for the value of DBV to be high when the ambient light level is high (e.g., when the display is outdoors during the day) and for the value of DBV to be low when the ambient light level is low (e.g., when the display is outdoors at night or indoors).

If dynamic variation of VDDEL is performed but the parking voltage Vp remains static, a resulting imbalance between the stress voltage applied during on-bias stress and the stress voltage applied during on-bias stress during anode reset may reduce front-of-screen (FOS) performance by, for example, adversely affecting threshold sampling performance. To reduce such imbalance, it may be desirable to vary Vp dynamically according to the DBV in an inverse manner to VDDEL.

Figure 12:
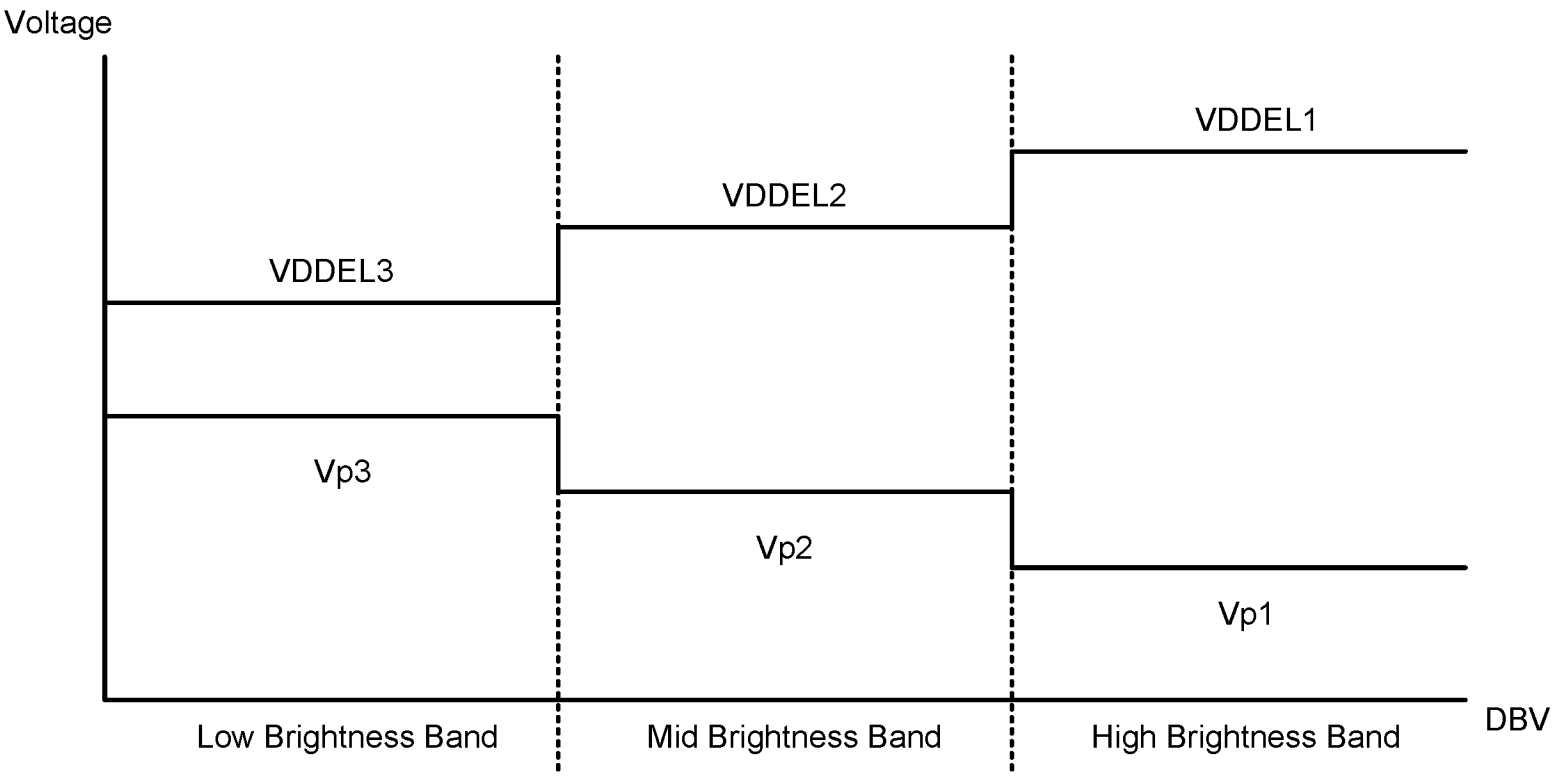
FIG. 12 illustrates the relationship between VDDEL and Vp throughout multiple brightness bands according to at least one aspect of the disclosure.

The range of possible values of the DBV may be divided into a number of brightness bands. For example, one or more brightness bands may be determined and used to define a model for values of the display supply voltage VDDEL and the parking voltage Vp. FIG. 12 illustrates a relationship between dynamic levels of VDDEL and Vp across multiple brightness bands according to at least one aspect of the disclosure. In this example, the range of the DBV is divided into three brightness bands: a low brightness band, a medium brightness band, and a high brightness band. Any number of brightness bands of uniform or of non-uniform width may be used. In one example of a non-uniform scheme, each brightness band is more narrow than the next lowest brightness band.

A low value of DBV may indicate a low value of display supply voltage VDDEL. The parking voltage for the on-bias stress during anode reset phase may be selected based on the current value of VDDEL and, by extension, on the brightness band that corresponds to the current value of the DBV. By selecting a parking voltage that corresponds to a dynamically selected VDDEL (which may be based on a selected maximum brightness of the display), undesirable artifacts such as flicker may be reduced. In some instances, VDDEL may be inversely proportional to the parking voltage such as the brightness increases, VDDEL increases and as VDDEL increases, the selected parking voltage decreases.

As shown, VDDEL and Vp may be represented as inversely correlated functions of the display brightness band. The middle brightness band may require a higher VDDEL value than the low brightness band, and consequently the parking voltage for the middle brightness band may be lower than the parking voltage at the low brightness band. The high brightness band may require an even higher VDDEL value than the middle brightness band, and consequently the parking voltage for the high brightness band may be even lower than the parking voltage at the middle brightness band.

Though three brightness bands are depicted in FIG. 12, any number of brightness bands may be used for each of VDDEL and Vp. In some instances, discrete values of DBV may be used rather than brightness bands. The discrete values may indicate a range of desired display brightness that increases, linearly or non-linearly, from a minimum brightness to a maximum brightness. It may be desirable to vary VDDEL proportionally with the variation in the values of DBV. Similarly, since Vp may be inversely correlated with VDDEL, Vp may also vary (inversely) proportionally with VDDEL. In those instances, the underlying VDDEL and Vp functions may appear linear if the display brightness values vary linearly, and they may appear non-linear if the display brightness values vary non-linearly. Each of VDDEL and Vp may be represented as a step function (e.g., having one corresponding value for each brightness band, as shown in FIG. 12), a linear function, a non-linear function, or the like. In addition, VDDEL and Vp may be represented as a same type function (e.g., both being linear, non-linear, etc.) or VDDEL and Vp may be different types of functions with one being linear (for example) and the other being non-linear (for example).

Figure 13:
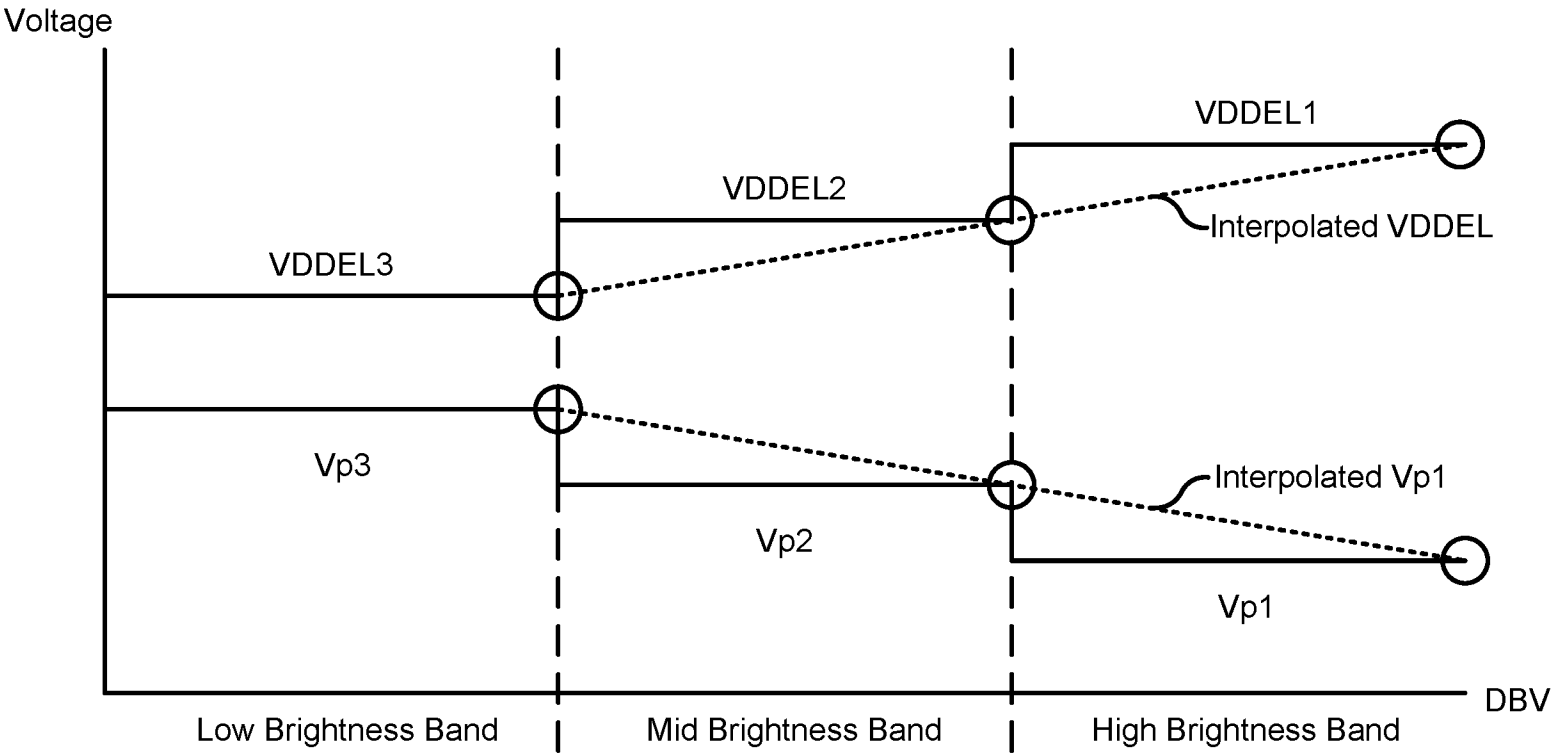
FIG. 13 illustrates the VDDEL and Vp interpolation models across multiple brightness bands according to at least one aspect of the disclosure.
Figure 14:
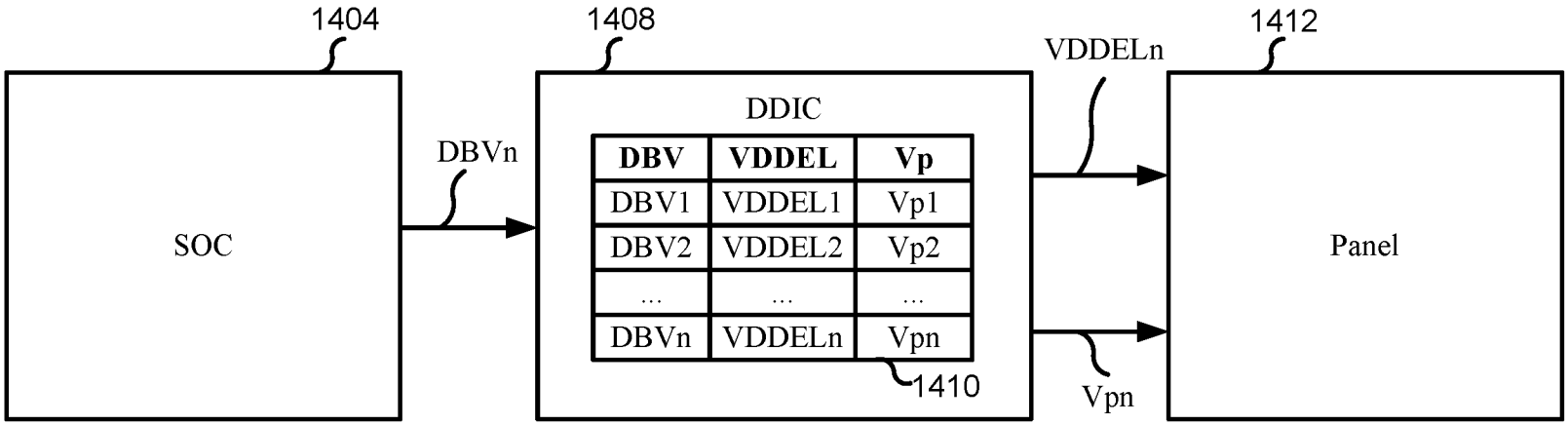
FIG. 14 illustrates a display driver system for driving a display according to at least one aspect of the disclosure.

FIG. 13 illustrates models of interpolation of VDDEL and Vp across multiple brightness bands according to at least one aspect of the disclosure. An interpolation model may define one or more additional values for each of VDDEL and Vp based on one or more given values of VDDEL and Vp ('anchor values'), such as values defined by respective step functions. In some instances, VDDEL and Vp values between the anchor values may be interpolated using a linear (or non-linear) interpolation model. For instance, as shown from FIG. 12, VDDEL and Vp may be represented as step functions of the brightness bands. As shown in FIG. 13, the value of VDDEL within each brightness band may be selected as an anchor value corresponding to the transition to the next highest brightness band, and likewise the value of Vp within each brightness band may be selected as an anchor value corresponding to the transition to the next highest brightness band. For the highest brightness band, the values of VDDEL and Vp within the band may be selected as anchor values corresponding to the highest value of DBV.An interpolation among the anchor values may then be performed for each of VDDEL and Vp, according to a desired interpolation function, to obtain corresponding values of VDDEL and Vp at each value of DBV. For example, a linear interpolation among the anchor values may be performed for each of VDDEL and Vp as shown in FIG. 14 to obtain a corresponding interpolated value for VDDEL and Vp at each value of DBV across the middle and high brightness bands. In an exponential (or other non-linear) interpolation model, three or more data points may be selected to define an exponential or other curved model for the values of each respective function. In some instances, both Vp and VDDEL models may be of a same type (e.g., linear, exponential, etc.) In other instances, the Vp model may be of one type and VDDEL model may be of a different type.

Such use of an interpolation model allows desired corresponding values of VDDEL and Vp for each value across a wide range of DBV to be represented by only a few anchor points, which may greatly reduce storage requirements. Interpolation models may also enable lower power consumption without inducing additional flicker or variable refresh. For instance, throughout the middle brightness band, the linear interpolation model shown in FIG. 13 indicates a lower display supply voltage than the default step function would supply (except for the edge between the middle brightness band and the high brightness band). The same lowering of VDDEL may be seen across the high brightness band. The parking voltage, being inversely correlated with VDDEL, may have interpolated values that are higher than the step function from which it is based. The interpolated parking voltage values, though higher than the underlying step function, are significantly lower than the corresponding values of VDDEL and may thus provide a net reduction in power consumption through the brightness bands. In such manner, flicker and variable refresh rate may be reduced by supporting a more gradual transition among dynamic levels of the parking voltage Vp and the display supply voltage VDDEL.

As similarly noted above, though three brightness bands are depicted in FIG. 13, any number of brightness bands may be used to define a interpolation mode for each of VDDEL and Vp. In some instances, discrete values of DBV may be used rather than brightness bands. The discrete values may indicate a range of desired display brightness that increases, linearly or non-linearly, from a minimum brightness to a maximum brightness. VDDEL may vary proportionally with variation in the values of DBV. In some instances, VDDEL may vary linearly or non-linearly with the variation in the display brightness value. Similarly, since Vp may be inversely correlated with VDDEL, Vp may also vary (inversely) with VDDEL. In those instances, the underlying VDDEL and Vp functions may appear linear if the display brightness values vary linearly, and they may appear non-linear if the display brightness values vary non-linearly. For some instances in which a corresponding value of VDDEL is provided for each value of DBV, a interpolation model may not be generated. In other instances, a interpolation model may be generated for each of VDDEL and Vp regardless of whether the underlying function is a step function (as depicted), a linear function, or a non-linear function.

FIG. 14 illustrates a display driver system for driving a display according to at least one aspect of the disclosure. The display driver system may include a system on a chip (SOC) 1404 that produces the image data for the pixels of display panel 1412, which may be an implementation of panel 14 as described above. SOC 1404 may include one or more processors and memory that stores instructions for controlling the operation of one or more display driver integrated circuits (DDICs) 1408, which may each be an implementation of DDIC 16 as described above. In some instances, SOC 1404 may use logic in addition to or in place of software. Memory of SOC 1404 may also store image data and/or information that describes a relation between ambient light level and DBV. SOC 1404 may decode media for display by display panel 1412.

SOC 1404 may be electrically coupled to one or more DDICs 1408 (e.g., over path 25 as shown in FIG. 1) to enable transmission of data and control signals from SOC 1404 to DDIC 1408. As shown in FIG. 14, the control signals may include a current value of DBV. In some instances, the display driver system may include one SOC 1404 that may transmit data and control signals to one or more DDICs 1408. Each DDIC 1408 may drive one or more pixels 22 of an array of panel 1412. In other instances, the display driver system may include multiple SOCs 1404, where each SOC 1404 may transmit data and control signals to one or more DDICs 1408 and each DDIC 1408 may drive one or more pixels 22 of an array of panel 1412.

DDIC 1408 may be electrically coupled to one or more pixels 22 of an array of pixels of panel 1412. DDIC 1408 may include one or more processors and memory that stores instructions for driving the one or more pixels 22. In some instances, DDIC 1408 may use logic in addition to or in place of the instructions. The memory may also store a correspondence between values of DBV and anchor values of VDDEL and Vp, such as a lookup table 1410 indexed on values of DBV as shown in FIG. 14. The correspondence may be stored, for example, into flash or other non-volatile memory during manufacture, during a software update, etc.

DDIC 1408 may receive data and control signals from SOC 1404 and use the data and control signals to drive the one or more pixels 22. The data signals may include, for example, grayscale red, green, and/or blue data signals. The control signals may include a value of DBV (e.g., for the frame) that may be used to determine an optimal display supply voltage VDDEL and parking voltage Vp by which to drive pixels of panel 1412 during an on-bias stress phase, an (on-bias stress during) anode reset phase, and/or other display stages as described herein. For instance, DDIC 1408 may be configured to receive a display brightness value DBV from SOC 1404; use the received display brightness value DBV to identify a pair of VDDEL anchor values and a pair of Vp values from table 1410 (e.g., the values indexed to the next-highest and next-lowest values of DBV in the table); interpolate between the pair of identified VDDEL anchor values to obtain an interpolated VDDEL value that corresponds to the received DBV; interpolate between the pair of identified Vp anchor values to obtain an interpolated Vp value that corresponds to the received DBV; and output, to panel 1412, VDDEL and Vp voltages that correspond to the interpolated values.

DDIC 1408 may generate control signals for each pixel or sets of pixels. The control signals may include, but are not limited to, parking voltages Vp; display supply voltages VDDEL; switching-transistor control signals such as Scan1, Scan2, EM1, and EM2 described herein; clock and/or other timing signals; combinations thereof; and the like. In some instances, DDIC 1408 may control other circuitry (e.g., row driver circuitry 18 and/or column driver circuitry 20) to generate one or more of the switching transistor control signals by providing, for example, a phase-initiation signal or other timing signal. In some instances, DDIC 1408 may also generate and provide the initialization voltage Vini and the ground power supply voltage VSSEL. In other instances, voltages that do not vary or vary infrequently, such as Vini and VSSEL, may be provided by a power supply of display device 1412. The control signals received from DDIC 1408 may cause pixel 22 to perform a reset/initialization phase, on-bias stress phase, (on-bias stress) during anode reset phase, threshold voltage sampling and data writing phase, and/or emission phase as described herein.

The VDDEL and Vp anchor values stored in table 1410 are digital values of parameters that identify corresponding (analog) voltage levels of VDDEL and Vp to be applied to the pixel circuits. The result of the interpolations among the anchor values are also digital values of the dynamic supply voltage and dynamic parking voltage parameters. DDIC 1408 may include one or more digital-to-analog (DAC) converters to convert the interpolated digital dynamic supply voltage parameter value into a supply voltage VDDEL that is output to panel 1412, and to convert the interpolated digital dynamic parking voltage parameter value into a parking voltage Vp that is output to panel 1412. Once the digital parameter values have been converted into corresponding analog voltage levels of supply voltage VDDEL and parking voltage Vp, they may be applied to pixel 22. In some instances, the DAC may be located between DDIC 1408 (e.g., within column driver circuitry 20).

Figure 15:
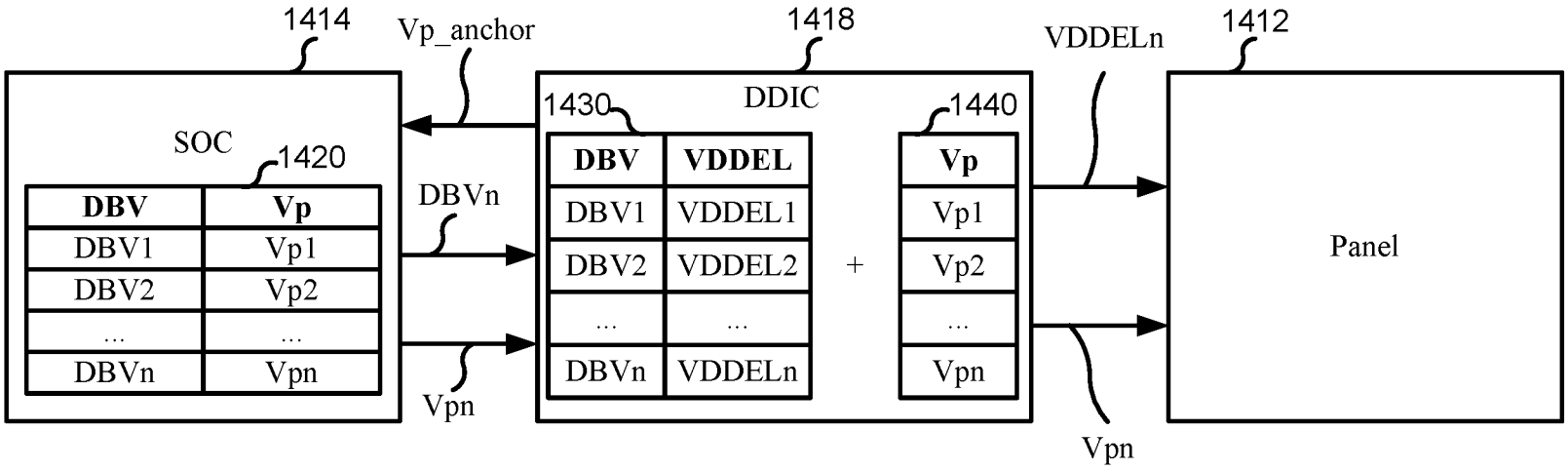
FIG. 15 illustrates a display driver system for driving a display according to at least one aspect of the disclosure.

FIG. 15 illustrates a display driver system for driving a display according to at least one aspect of the disclosure. The display drive system may include an implementation 1414 of SoC 1404 that has the features described above and operates in a similar manner as described above to produce image data for pixels of display panel 1412. The display drive system may also include an implementation 1418 of DDIC 1408 that likewise has the features described above and operates in a similar manner to receive values of DBV from SoC 1414 and output corresponding dynamic values of VDDEL and Vp to panel 1412. Differences in operation between SoCs 1404 and 1414, and between DDICs 1408 and 1418, are now described.

As opposed to the table 1410 of DDIC 1408, a memory of DDIC 1418 may store a correspondence between values of DBV and anchor values of VDDEL, such as a lookup table 1430 indexed on values of DBV as shown in FIG. 15, and a list of anchor values of Vp, such as table 1440 as shown in FIG. 15. The correspondence and list of DDIC 1418 (e.g., table 1430 and list 1440) may be the same as the corresponding portions of the correspondence of DDIC 1408 (e.g., table 1410) as described above. The correspondence and list may be stored, for example, into flash or other non-volatile memory during manufacture, during a software update, etc.

In this implementation, DDIC 1418 provides the stored list of Vp anchor values to SoC 1414 (e.g., during a power-up sequence). During subsequent display operation, SoC 1414 performs interpolation of Vp for a value of DBV for a current frame (based on the list of Vp anchor points and as described above with reference to DDIC 1408). For example, SoC 1414 may be configured to interpolate between the Vp anchor values indexed to the next-highest and next-lowest values of DBV in list 1440. SoC 1414 provides the value of DBV and the corresponding interpolated digital value for Vp to DDIC 1418.

In response to receiving the value of DBV, DDIC 1418 determines a corresponding interpolated digital value for VDDEL (based on the table of VDDEL anchor points 1430 and as described above with reference to DDIC 1408). For example, DDIC 1418 may be configured to interpolate between the VDDEL anchor values indexed to the next-highest and next-lowest values of DBV in table 1430. Based on the interpolated digital value for VDDEL and the interpolated digital value for Vp received from SoC 1414, DDIC 1418 produces corresponding analog voltage levels of supply voltage VDDEL and parking voltage Vp to panel 1412 (e.g., as described above with reference to DDIC 1408).

As described above with reference to DDIC 1408, the functions applied during the interpolation operations may be linear or non-linear, the widths of the underlying brightness bands may be uniform or non-uniform, etc. Like DDIC 1408, DDIC 1418 may be configured to produce one or more control signals to panel 1412 and/or may control other circuitry (e.g., row driver circuitry 18 and/or column driver circuitry 20) to generate one or more such signals (e.g., one or more of the switching transistor control signals) by providing, for example, a phase-initiation signal or other timing signal.

The principles described herein may also be applied to light-emitting diode pixel circuits whose transistors are p-type, rather than n-type as shown in FIG. 4, as well as to light-emitting diode pixel circuits that include both n-type and p-type transistors. Although a 6T1C pixel circuit is shown in FIG. 4 as one example, one of skill will understand that the practice of dynamic VDDEL and Vp with other pixel circuit configurations (e.g., 7T1C, etc.) is hereby contemplated and fully disclosed herein.

Figure 16:
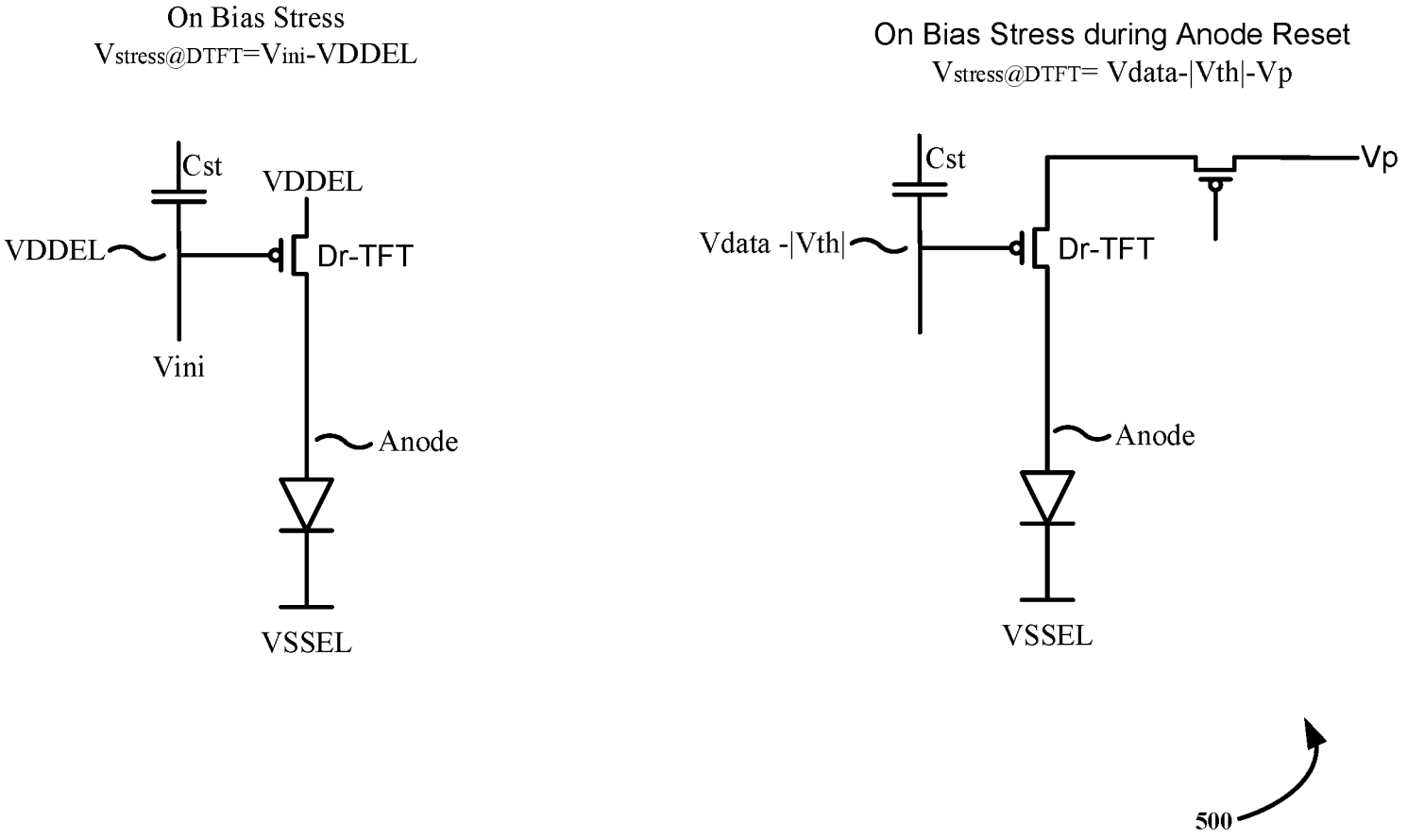
FIG. 16 illustrates a portion of a P-type transistor pixel circuit during on-bias stress and on-bias stress during anode reset according to at least one aspect of the disclosure.

FIG. 16 illustrates a portion of a P-type transistor pixel circuit during on-bias stress and on-bias stress during anode reset according to at least one aspect of the disclosure. As opposed to n-type transistors, p-type transistors may enable current to flow across the channel (between source and drain) when voltage at the gate is low and prevent current flow across the channel when the voltage at the gate is high. Accordingly, the state of a control signal to drive a transistor of the pixel circuit may be inverted when the transistor is p-type rather than n-type: a control signal that is pulled high to turn on an n-type transistor may be pulled low instead to turn on the transistor when it is p-type, and vice versa. In low power and low refresh rate displays, the p-type pixel circuit may perform the same phases as the n-type pixel circuit as described above (e.g., initialization, on-bias stress, threshold sampling and data write, emission, anode reset).

For instance, the p-type pixel circuit during on-bias stress may be represented using a first P-type transistor Dr-TFT as the drive transistor having a threshold voltage that is critical to the emission current of pixel 22. The source of Dr-TFT may be electrically coupled to VDDEL, and the drain of Dr-TFT may be electrically coupled to the anode of the light-emitting diode (such as an organic light-emitting diode). The cathode of the light-emitting diode may be electrically coupled to VSSEL. The gate of Dr-TFT may be electrically coupled to a terminal of storage capacitor Cst. The voltage at this terminal may be charged to an initialization voltage Vini such that the on-bias stress voltage may be Vini-VDDEL.

On-bias stress may also be performed during an anode reset phase of the P-type-based pixel circuit. During anode reset, on-bias stress may be performed by applying a particular parking voltage Vp to the drain of Dr-TFT. The parking voltage may be selected based on VDDEL, and VDDEL may be selected based on the current brightness band or value of DBV. The parking voltage may be inversely correlated with VDDEL such that as the display brightness value increases, VDDEL may also increase while Vp may decrease. In some instances, Vp may be inversely proportional to VDDEL such that an increase in VDDEL by x may cause Vp to decrease by kx, where k is a positive non-zero factor. On-bias stress during anode reset may cause the voltage at the anode of the light-emitting diode to be less than the threshold voltage for the light-emitting diode while Dr-TFT may remain turned on.

The parking voltage Vp may be supplied to the source of the drive transistor using, for example, a second P-type transistor as shown in FIG. 16. The second P-type transistor may enable selective application of Vp to the source of drive transistor Dr-TFT. As shown in FIG. 16, Vp may be applied to one of the channel terminals (e.g., the drain) of the second P-type transistor. When the gate of this transistor is driven low, the transistor may activate such that Vp appears at the source of the transistor, which may be electrically coupled to the source of drive transistor Dr-TFT. Applying Vdata−|Vth| to the gate of Dr-TFT at this time activates Dr-TFT such that Vp is applied to the channel of Dr-TFT. When the gate of the second P-type transistor is driven high, the second P-type transistor may deactivate, isolating the source of drive transistor Dr-TFT from the parking voltage.

The gate of drive transistor Dr-TFT for on-bias stress during anode reset may be driven to Vdata−|Vth|. As in the on-bias stress phase, the drain of drive transistor Dr-TFT is electrically coupled to the anode of the light emitting diode, and the cathode of the light emitting diode may be driven to VSSEL. The on-bias stress voltage during anode reset may be the gate-to-source voltage of drive transistor Dr-TFT, which may be Vdata−|Vth|−Vp.

The various ways for operating display 14 described in connection with FIGS. 5-16 are not mutually exclusive and can be used in conjunction with one another to reduce flicker, improve first-frame performance, and/or improve black levels in low-refresh-rate displays.

Figure 17:
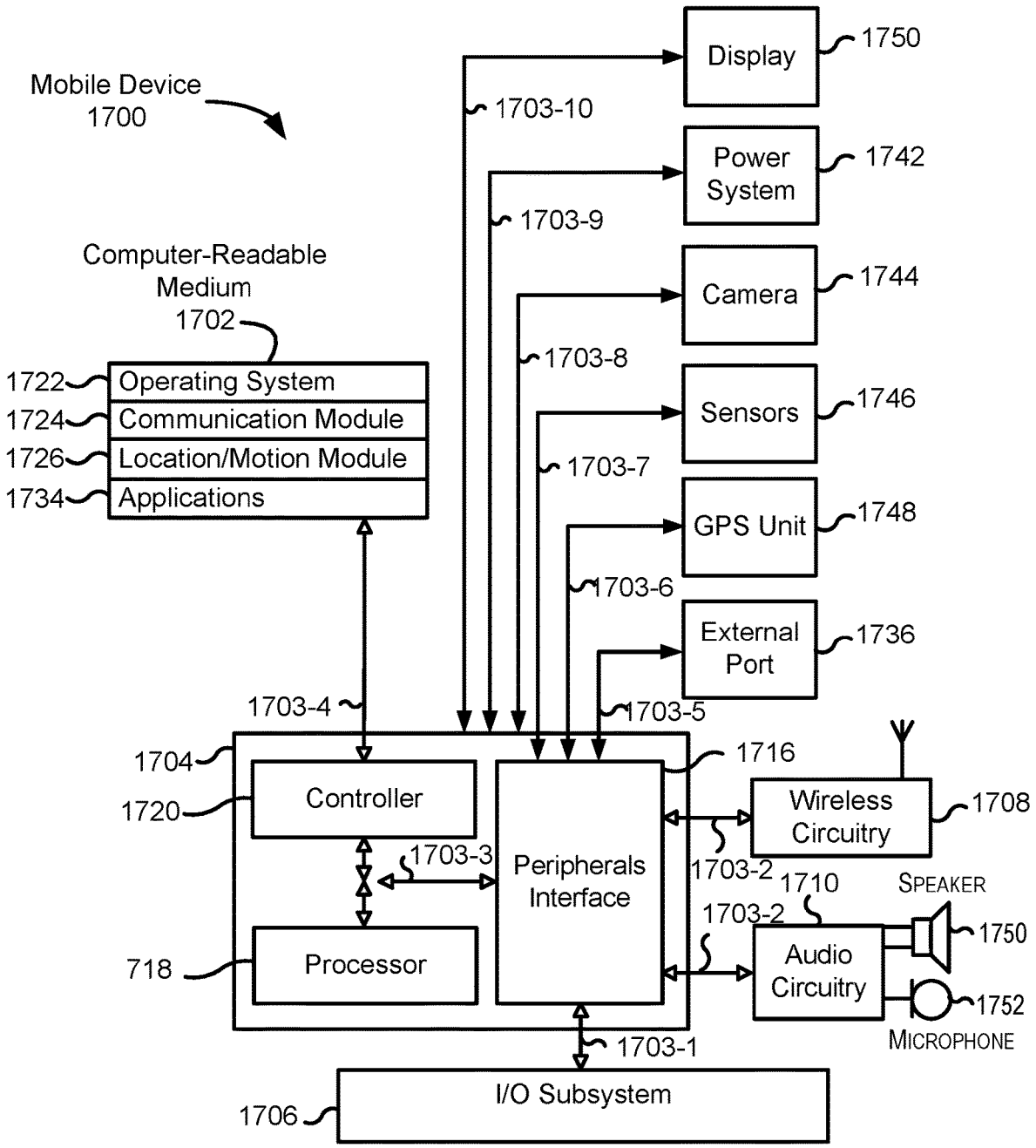
FIG. 17 illustrates an exemplary device including a light-emitting diode display according to at least one aspect of the disclosure.

FIG. 17 illustrates an exemplary device including a light-emitting diode display according to at least one aspect of the disclosure. Device 1700 generally includes computer-readable medium 1702, a processing system 1704, an Input/Output (I/O) subsystem 1706, wireless circuitry 1708, and audio circuitry 1710 including speaker 1750 and microphone 1752. These components may be coupled by one or more communication buses or signal lines 1703. Device 1700 can be any portable electronic device, including a handheld computer, a tablet computer, a mobile phone, smart watch, laptop computer, tablet device, media player, personal digital assistant (PDA), a key fob, a car key, an access card, a multi-function device, a mobile phone, a portable gaming device, or the like, including a combination of two or more of these items.

It should be apparent that the architecture shown in FIG. 17 is only one example of an architecture for device 1700, and that device 1700 can have more or fewer components than shown, or a different configuration of components. The various components shown in FIG. 17 can be implemented in hardware, software, or a combination of both hardware and software, including one or more signal processing and/or application specific integrated circuits.

Wireless circuitry 1708 is used to send and receive information over a wireless link or network to one or more other devices' conventional circuitry such as an antenna system, an RF transceiver, one or more amplifiers, a tuner, one or more oscillators, a digital signal processor, a CODEC chipset, memory, etc. Wireless circuitry 1708 can use various protocols, e.g., as described herein.

Wireless circuitry 1708 is coupled to processing system 1704 via peripherals interface 1716. Peripherals interface 1716 can include conventional components for establishing and maintaining communication between peripherals and processing system 1704. Voice and data information received by wireless circuitry 1708 (e.g., in speech recognition or voice command applications) is sent to one or more processors 1718 via peripherals interface 1716. One or more processors 1718 are configurable to process various data formats for one or more application programs 1734 stored on medium 1702.

Peripherals interface 1716 couple the input and output peripherals of the device to processor 1718 and computer-readable medium 1702. One or more processors 1718 communicate with computer-readable medium 1702 via a controller 1720. Computer-readable medium 1702 can be any device or medium that can store code and/or data for use by one or more processors 1718. Medium 1702 can include a memory hierarchy, including cache, main memory and secondary memory.

Device 1700 also includes a power system 1742 for powering the various hardware components. Power system 1742 can include a power management system, one or more power sources (e.g., battery, alternating current (AC)), a recharging system, a power failure detection circuit, a power converter or inverter, a power status indicator (e.g., a light emitting diode (LED)) and any other components typically associated with the generation, management and distribution of power in mobile devices.

In some instances, device 1700 includes a camera 1744. In some instances, device 1700 includes sensors 1746. Sensors can include accelerometers, compass, gyrometer, pressure sensors, audio sensors, light sensors, barometers, and the like. Sensors 1746 can be used to sense location aspects, such as auditory or light signatures of a location.

In some instances, device 1700 can include a GPS receiver, sometimes referred to as a GPS unit 1748. A mobile device can use a satellite navigation system, such as the Global Positioning System (GPS), to obtain position information, timing information, altitude, or other navigation information. During operation, the GPS unit can receive signals from GPS satellites orbiting the Earth. The GPS unit analyzes the signals to make a transit time and distance estimation. The GPS unit can determine the current position (current location) of the mobile device. Based on these estimations, the mobile device can determine a location fix, altitude, and/or current speed. A location fix can be geographical coordinates such as latitudinal and longitudinal information.

One or more processors 1718 run various software components stored in medium 1702 to perform various functions for device 1700. In some instances, the software components include an operating system 1722, a communication module (or set of instructions) 1724, a location module (or set of instructions) 1726, other applications (or set of instructions) 1734, such as applications that render images or other media on a display 1750 of mobile device 1700, which may be an implementation of display 14 as described herein and may receive data and/or control signals over bus or line 1703-10, which may be an implementation of signal path 25 as described herein. The pixels of display 1750 may be driven by one or more display driver integrated circuits of the display that may cause and/or perform, as described above, an on-bias stress phase and an on-bias stress during anode reset phase to reduce first frame dimming, flicker, and/or other visual artifacts on display 1750.

Operating system 1722 can be any suitable operating system, including iOS, Mac OS, Darwin, RTXC, LINUX, UNIX, OS X, WINDOWS, or an embedded operating system such as VxWorks. The operating system can include various procedures, sets of instructions, software components and/or drivers for controlling and managing general system tasks (e.g., memory management, storage device control, power management, etc.) and facilitates communication between various hardware and software components.

Communication module 1724 facilitates communication with other devices over one or more external ports 1736 or via wireless circuitry 1708 and includes various software components for handling data received from wireless circuitry 1708 and/or external port 1736. External port 1736 (e.g., USB, FireWire, Lightning connector, 60-pin connector, etc.) is adapted for coupling directly to other devices or indirectly over a network (e.g., the Internet, wireless LAN, etc.).

Location/motion module 1726 can assist in determining the current position (e.g., coordinates or other geographic location identifier) and motion of device 1700. Modern positioning systems include satellite based positioning systems, such as Global Positioning System (GPS), cellular network positioning based on "cell IDs," and Wi-Fi positioning technology based on a Wi-Fi networks. GPS also relies on the visibility of multiple satellites to determine a position estimate, which may not be visible (or have weak signals) indoors or in "urban canyons." In some instances, location/motion module 1726 receives data from GPS unit 1748 and analyzes the signals to determine the current position of the mobile device. In some instances, location/motion module 1726 can determine a current location using Wi-Fi or cellular location technology. For example, the location of the mobile device can be estimated using knowledge of nearby cell sites and/or Wi-Fi access points with knowledge also of their locations. Information identifying the Wi-Fi or cellular transmitter is received at wireless circuitry 1708 and is passed to location/motion module 1726. In some instances, the location module receives the one or more transmitter IDs. In some instances, a sequence of transmitter IDs can be compared with a reference database (e.g., Cell ID database, Wi-Fi reference database) that maps or correlates the transmitter IDs to position coordinates of corresponding transmitters, and computes estimated position coordinates for device 1700 based on the position coordinates of the corresponding transmitters. Regardless of the specific location technology used, location/motion module 1726 receives information from which a location fix can be derived, interprets that information, and returns location information, such as geographic coordinates, latitude/longitude, or other location fix data.

The one or more applications 1734 on the mobile device can include any applications installed on the device 1700, including without limitation, a browser, address book, contact list, email, instant messaging, word processing, keyboard emulation, widgets, JAVA-enabled applications, encryption, digital rights management, voice recognition, voice replication, a music player (which plays back recorded music stored in one or more files, such as MP3 or AAC files), etc.

There may be other modules or sets of instructions (not shown), such as a graphics module, a time module, etc. For example, the graphics module can include various conventional software components for rendering, animating and displaying graphical objects (including without limitation text, web pages, icons, digital images, animations and the like) on a display surface (e.g., display 1750). In another example, a timer module can be a software timer. The timer module can also be implemented in hardware. The time module can maintain various timers for any number of events.

The I/O subsystem 1706 may be coupled to display 1750, which can be a touch-sensitive display. The display displays visual output to the user in a GUI. The visual output can include text, graphics, video, and any combination thereof. Some or all of the visual output can correspond to user-interface objects. A display can use LED (light emitting diode), LCD (liquid crystal display) technology, or LPD (light emitting polymer display) technology, although other display technologies can be used in other instances. For instance, the display may be an organic light-emitting diode display such as display 14 described above. The pixels of the display may be driven by one or more display driver integrated circuits of the display that perform among, other phases described above, an on-bias stress phase and an on-bias stress during anode reset phase to reduce first frame dimming, flicker, and/or other visual artifacts on the display.

In some instances, I/O subsystem 1706 can be coupled to a display and user input devices such as a keyboard, mouse, and/or track pad. In some instances, I/O subsystem 1706 can be coupled to a touch-sensitive display. A touch-sensitive display can also accept input from the user based on haptic and/or tactile contact. In some instances, a touch-sensitive display forms a touch-sensitive surface that accepts user input. The touch-sensitive display/surface (along with any associated modules and/or sets of instructions in medium 1702) detects contact (and any movement or release of the contact) on the touch-sensitive display and converts the detected contact into interaction with user-interface objects, such as one or more soft keys, that are displayed on the touch screen when the contact occurs. In some instances, a point of contact between the touch-sensitive display and the user corresponds to one or more digits of the user. The user can make contact with the touch-sensitive display using any suitable object or appendage, such as a stylus, pen, finger, and so forth. A touch-sensitive display surface can detect contact and any movement or release thereof using any suitable touch sensitivity technologies, including capacitive, resistive, infrared, and surface acoustic wave technologies, as well as other proximity sensor arrays or other elements for determining one or more points of contact with the touch-sensitive display.

Further, the I/O subsystem can be coupled to one or more other physical control devices (not shown), such as push-buttons, keys, switches, rocker buttons, dials, slider switches, sticks, LEDs, etc., for controlling or performing various functions, such as power control, speaker volume control, ring tone loudness, keyboard input, scrolling, hold, menu, screen lock, clearing and ending communications and the like. In some instances, in addition to the touch screen, device 1700 can include a touchpad (not shown) for activating or deactivating particular functions. In some instances, the touchpad is a touch-sensitive area of the device that, unlike the touch screen, does not display visual output. The touchpad can be a touch-sensitive surface that is separate from the touch-sensitive display or an extension of the touch-sensitive surface formed by the touch-sensitive display.

In some instances, some or all of the operations described herein can be performed using an application executing on the user's device. Circuits, logic modules, processors, and/or other components may be configured to perform various operations described herein. Those skilled in the art will appreciate that, depending on implementation, such configuration can be accomplished through design, setup, interconnection, and/or programming of the particular components and that, again depending on implementation, a configured component might or might not be reconfigurable for a different operation. For example, a programmable processor can be configured by providing suitable executable code; a dedicated logic circuit can be configured by suitably connecting logic gates and other circuit elements; and so on.

Any of the software components or functions described in this application may be implemented as software code to be executed by a processor using any suitable computer language such as, for example, Java, C, C++, C #, Objective-C, Swift, or scripting language such as Perl or Python using, for example, conventional or object-oriented techniques. The software code may be stored as a series of instructions or commands on a computer readable medium for storage and/or transmission. A suitable non-transitory computer readable medium can include random access memory (RAM), a read only memory (ROM), a magnetic medium such as a hard-drive or a floppy disk, or an optical medium such as a compact disk (CD) or DVD (digital versatile disk), flash memory, and the like. The computer readable medium may be any combination of such storage or transmission devices.

Computer programs incorporating various features of the present invention may be encoded on various computer readable storage media; suitable media include magnetic disk or tape, optical storage media such as compact disk (CD) or DVD (digital versatile disk), flash memory, and the like. Computer readable storage media encoded with the program code may be packaged with a compatible device or provided separately from other devices. In addition program code may be encoded and transmitted via wired optical, and/or wireless networks conforming to a variety of protocols, including the Internet, thereby allowing distribution, e.g., via Internet download. Any such computer readable medium may reside on or within a single computer product (e.g. a hard drive, a CD, or an entire computer system), and may be present on or within different computer products within a system or network. A computer system may include a monitor, printer, or other suitable display for providing any of the results mentioned herein to a user.

Figure 18:
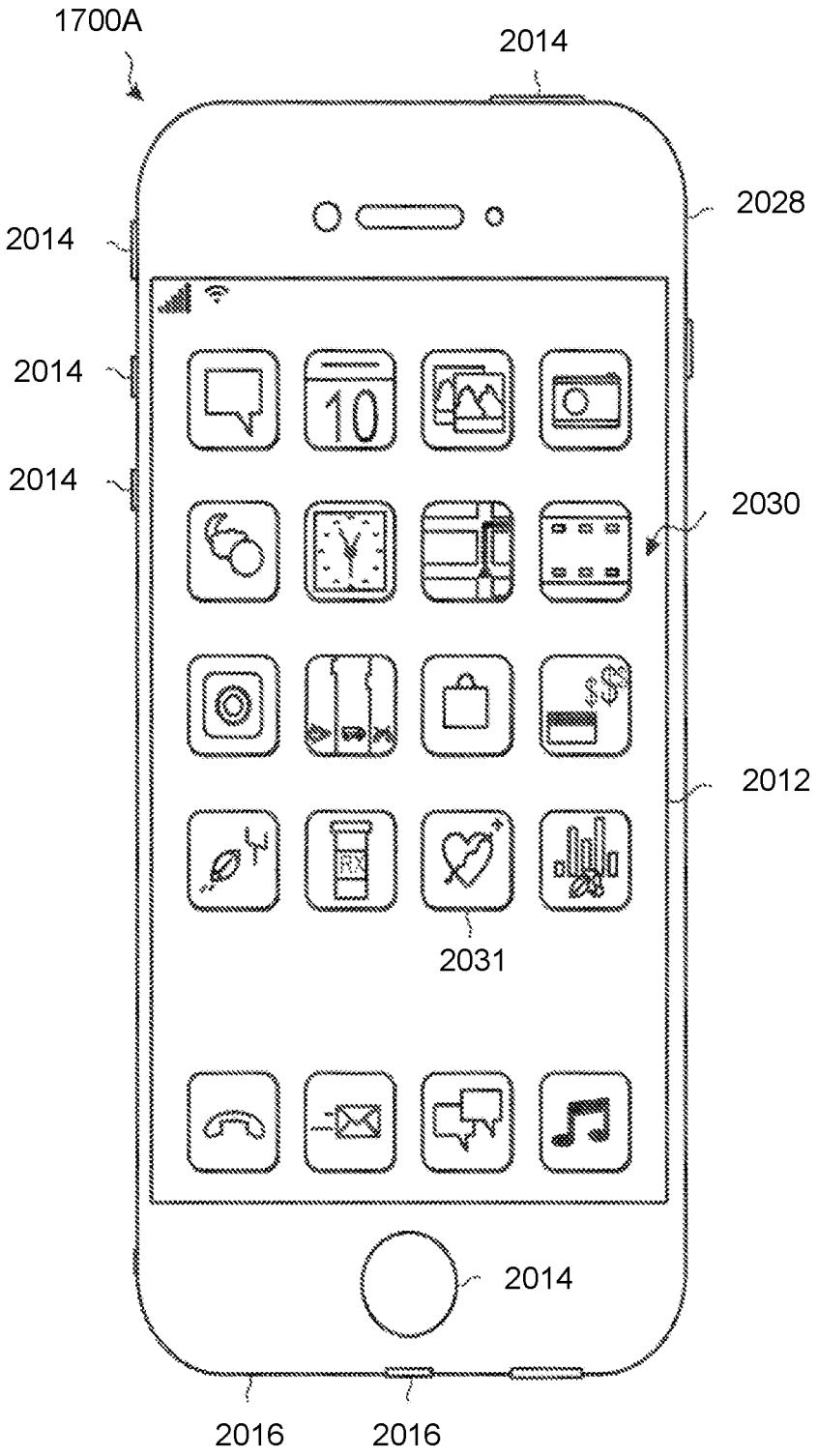
FIG. 18 illustrates an exemplary smart phone including a light-emitting diode display according to at least one aspect of the disclosure.

As described above, the computing device 1700 may be any suitable electronic device. To help illustrate, one example of a handheld device 1700A is described in FIG. 18, which may be a portable phone, a media player, a personal data organizer, a handheld game platform, or any combination of such devices. For example, the handheld device 1700A may be a smart phone, such as any iPhone® model available from Apple Inc. As depicted, the handheld device 1700A includes an enclosure 2028, which may protect interior components from physical damage and to shield them from electromagnetic interference. The enclosure 2028 may surround the electronic display 2012, which, in the depicted embodiment, displays a graphical user interface (GUI) 2030 having an array of icons 2031. By way of example, when an icon 2031 is selected either by an input structure 2014 (e.g., a button) or a touch component of the electronic display 2012, an application program may launch.

Additionally, as depicted, input structure 2014 may open through the enclosure 2028. As described above, the input structures 2014 may allow a user to interact with the handheld device 1700A. For example, the input structures 2014 may activate or deactivate the handheld device 1700A, navigate a user interface to a home screen, navigate a user interface to a user-configurable application screen, activate a voice recognition feature, provide volume control, and toggle between vibrate and ring modes. Furthermore, as depicted, the I/O ports 2016 open through the enclosure 28. In some embodiments, the I/O ports 2016 may include, for example, an audio jack to connect to external devices.

Figure 19:
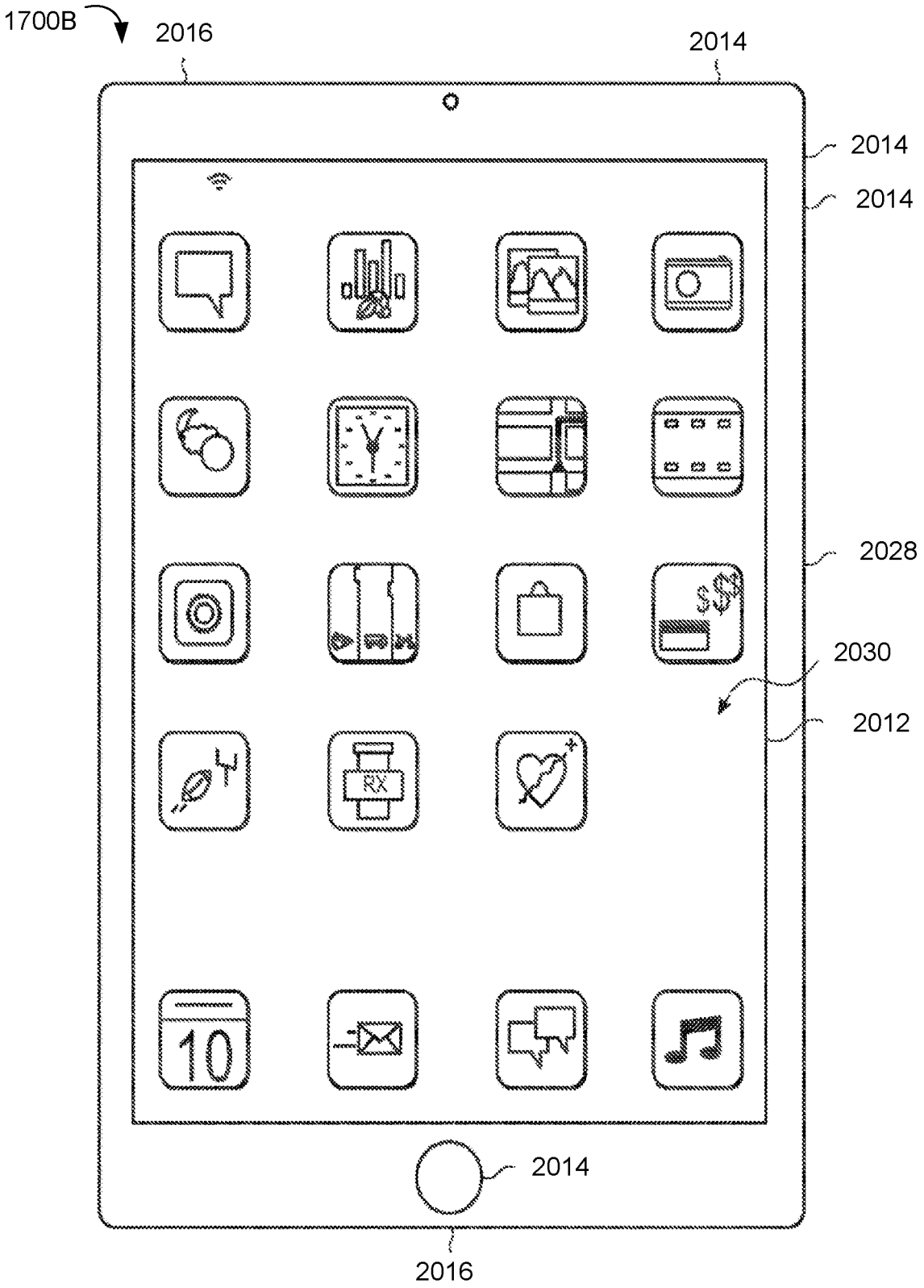
FIG. 19 illustrates an exemplary tablet including a light-emitting diode display according to at least one aspect of the disclosure.
Figure 20:
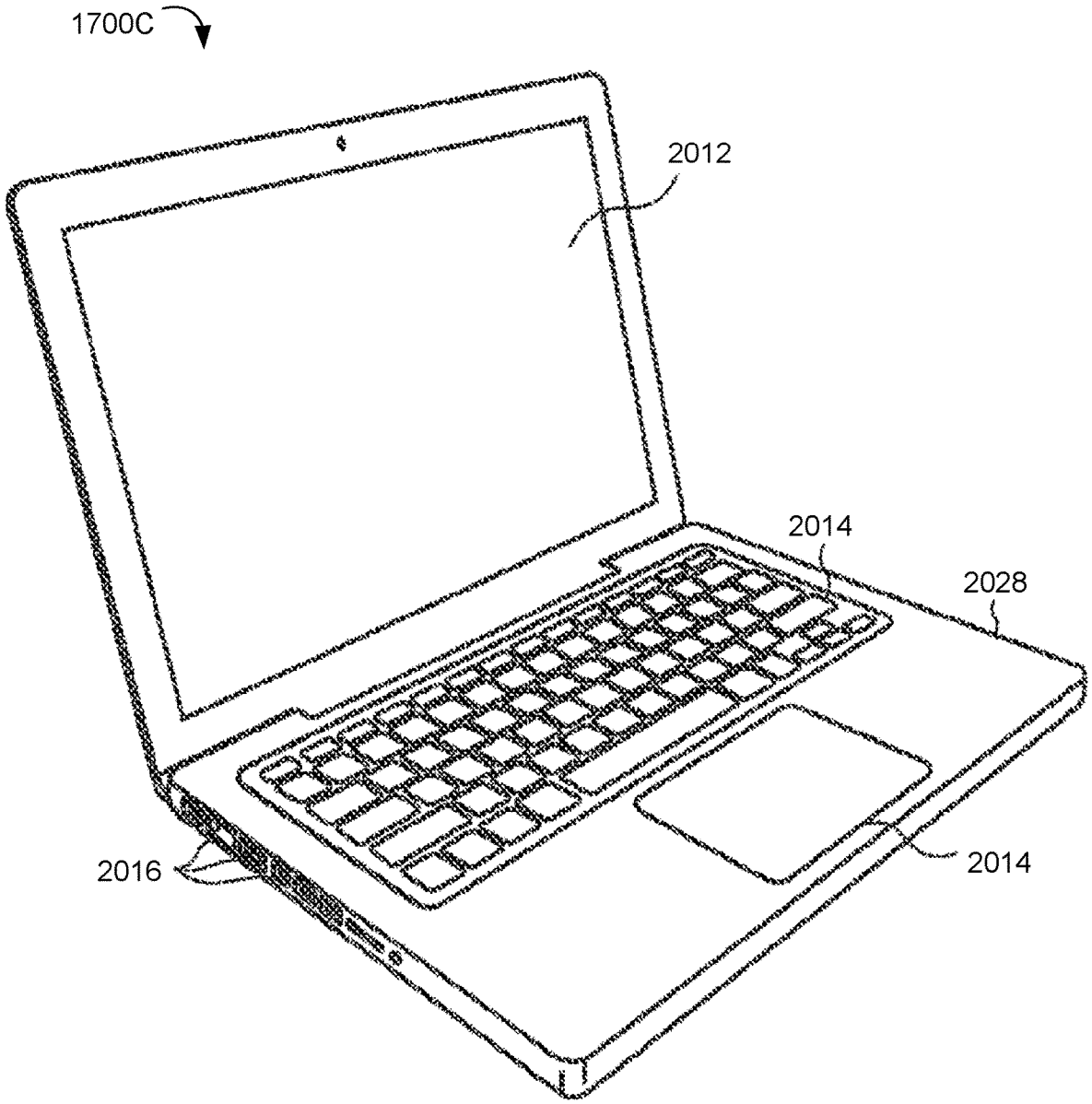
FIG. 20 illustrates an exemplary laptop computer including a light-emitting diode display according to at least one aspect of the disclosure.
Figure 21A:
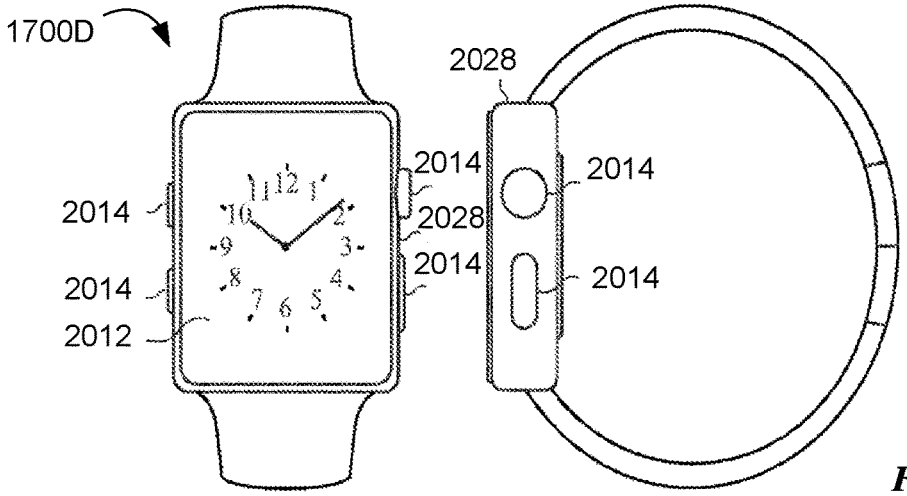
FIG. 21A illustrates an exemplary watch including a light-emitting diode display according to at least one aspect of the disclosure.

To further illustrate a suitable computing device 1700, a tablet device 1700B is described in FIG. 19, such as any iPad® model available from Apple Inc. Additionally, in other embodiments, the computing device 1700 may take the form of a computer 1700C as described in FIG. 20, such as any Macbook® or iMac® model available from Apple Inc. Furthermore, in other embodiments, the computing device 1700 may take the form of a watch 1700D as described in FIG. 21A, such as an Apple Watch® model available from Apple Inc. As depicted, the tablet device 1700B, the computer 1700C, and the watch 1700D may each also include an electronic display 2012, input structures 2014, I/O ports 2016, an enclosure 2028, or any combination thereof.

Figure 21B:
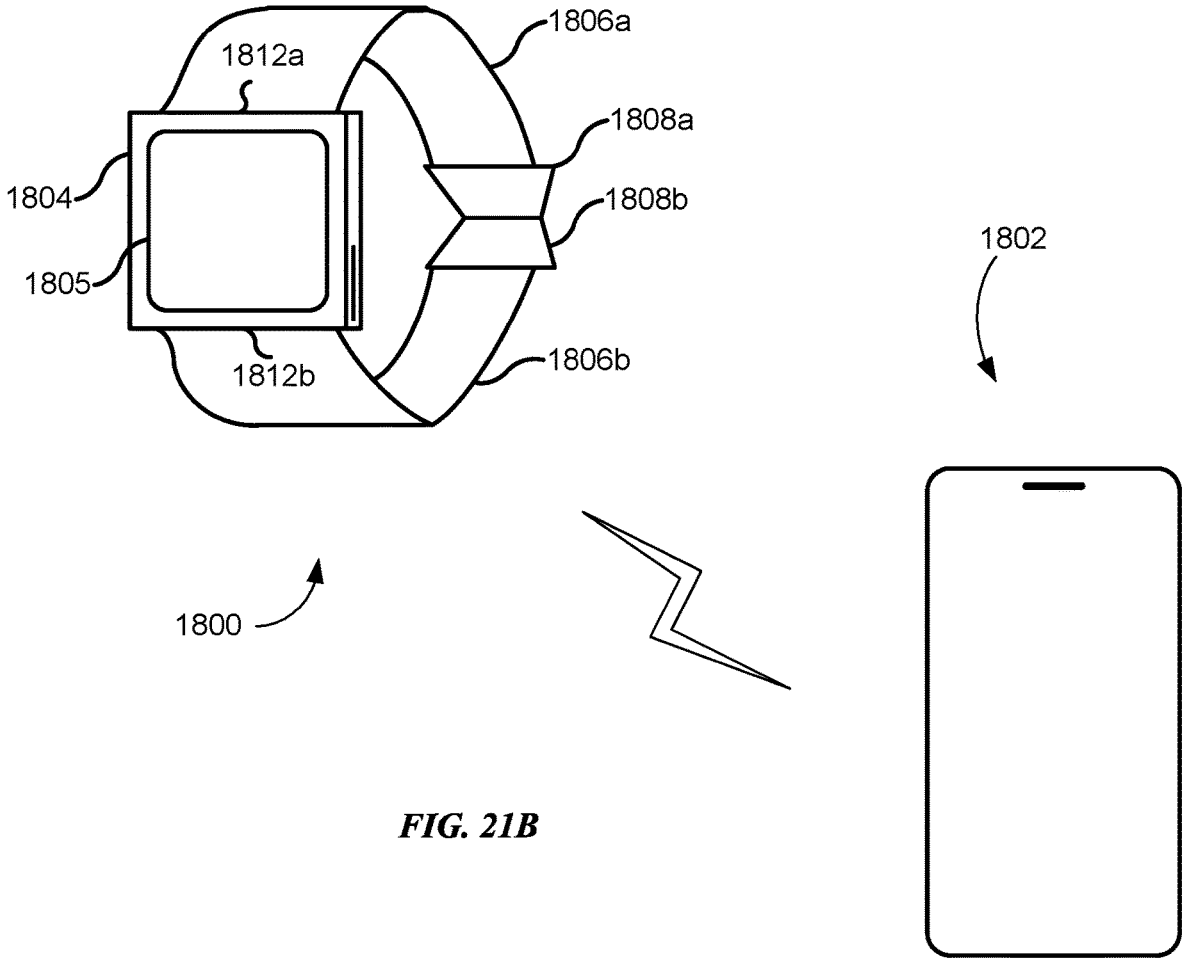
FIG. 21B illustrates an exemplary wearable device including a light-emitting diode display according to at least one aspect of the disclosure.

FIG. 21B illustrates an implementation of device 1700 as an exemplary wearable device 1800 including a light-emitting diode display according to at least one aspect of the disclosure. Wearable device 1800 may be configured to communicate wirelessly with a host device 102. In this example, wearable device 1800 is shown as a wristwatch-like device with a face portion 1804 connected to straps 1806*a*, 1806*b*.

Face portion 1804 can include, e.g., a touchscreen display 1805 that can be appropriately sized depending on where on a user's person wearable device 1800 is intended to be worn. A user can view information presented by wearable device 1800 on touchscreen display 1805 and provide input to wearable device 1800 by touching touchscreen display 1805. In some instances, touchscreen display 1805 can occupy most or all of the front surface of face portion 1804. Touchscreen display 1805 may be any type of display such as display 14 described above. The pixels of touchscreen display 1805 may be driven by one or more display driver integrated circuits of display 14 that may cause and/or perform, as described above, an on-bias stress phase and an on-bias stress during anode reset phase to reduce first frame dimming, flicker, and/or other visual artifacts on touchscreen display 1805.

Straps 1806*a*, 1806*b* can be provided to allow device 1800 to be removably worn by a user, e.g., around the user's wrist. In some instances, straps 1806*a*, 1806*b* can be made of any flexible material (e.g., fabric, flexible plastic, leather, a chain of flexibly interleaved plates or links made of metal or other rigid materials) and can be connected to face portion 1804, e.g., by hinges. Alternatively, straps 1806*a*, 1806*b* can be made of a rigid material, with one or more hinges positioned at the junction of face 1804 and proximal ends 1812*a*, 1812*b* of straps 1806*a*, 1806*b* and/or elsewhere along the lengths of straps 1806*a*, 1806*b* to allow a user to put on and take off wearable device 1800. Different portions of straps 1806*a*, 1806*b* can be made of different materials; for instance, flexible or expandable sections can alternate with rigid sections. In some instances, one or both of straps 1806*a*, 1806*b* can include removable sections, allowing wearable device 1800 to be resized to accommodate a particular user's wrist size. In some instances, straps 1806*a*, 1806*b* can be portions of a continuous strap member that runs behind or through face portion 1804. Face portion 1804 can be detachable from straps 1806*a*, 1806*b*; permanently attached to straps 1806*a*, 1806*b*; or integrally formed with straps 1806*a*, 1806*b*.

The distal ends of straps 1806*a*, 1806*b* opposite face portion 1804 can provide complementary clasp members 1808*a*, 1808*b* that can be engaged with each other to secure the distal ends of straps 1806 *a*, 1806*b* to each other, forming a closed loop. In this manner, device 1800 can be secured to a user's person, e.g., around the user's wrist; clasp members 1808*a*, 1808*b* can be subsequently disengaged to facilitate removal of device 1800 from the user's person. The design of clasp members 1808*a*, 1808*b* can be varied; in various instances, clasp members 1808*a*, 1808*b* can include buckles, magnetic clasps, mechanical clasps, snap closures, etc. In some instances, one or both of clasp members 1808*a*, 1808*b* can be movable along at least a portion of the length of corresponding strap 1806*a*, 1806*b*, allowing wearable device 1800 to be resized to accommodate a particular user's wrist size.

Straps 1806*a*, 1806*b* can be two distinct segments, or they can be formed as a continuous band of an elastic material (including, e.g., elastic fabrics, expandable metal links, or a combination of elastic and inelastic sections), allowing wearable device 1800 to be put on and taken off by stretching a band formed of straps 1806*a*, 1806*b*. In those instances, clasp members 1808*a*, 1808*b* can be omitted.

Straps 1806*a*, 1806*b* and/or clasp members 1808*a*, 1808*b* can include sensors that allow wearable device 1800 to determine whether it is being worn at any given time. Wearable device 1800 can operate differently depending on whether it is currently being worn or not. For example, wearable device 1800 can inactivate various user interface and/or RF interface components when it is not being worn. In addition, in some instances, wearable device 1800 can notify host device 1802 when a user puts on or takes off wearable device 1800.

Although the invention has been described with respect to specific embodiments, it will be appreciated that the invention is intended to cover all modifications and equivalents within the scope of the following claims.

What is claimed is:

1. A method of driving a display, the method comprising:

receiving, by a display driver integrated circuit, a first value of a display brightness parameter that is a digital quantity that is equal to an amount of light output by the display;

determining a first value of a dynamic supply voltage parameter, wherein the first value of the dynamic supply voltage parameter is based on the first value of the display brightness parameter;

applying, over a first time interval, a first supply voltage to one of a gate of a drive transistor of a light-emitting-diode circuit and a channel of the drive transistor, wherein the drive transistor is turned on during at least part of the first time interval, and wherein the first supply voltage is based on the first value of the dynamic supply voltage parameter; and applying, over a second time interval, a first parking voltage to an anode of a light-emitting diode of the light-emitting-diode circuit and to the channel of the drive transistor, wherein the drive transistor is turned on during at least part of the second time interval, and wherein the first parking voltage corresponds to the first value of the dynamic supply voltage parameter and is below a threshold voltage of the light-emitting diode.

2. The method of claim 1, the method further comprising:

receiving, by the display driver integrated circuit, a second value of the display brightness parameter that is higher than the first value of the display brightness parameter;

determining a second value of the dynamic supply voltage parameter, wherein the second value of the dynamic supply voltage parameter is based on the second value of the display brightness parameter;

applying, over a third time interval, a second supply voltage to the one of the gate and the channel of the drive transistor, the second supply voltage being higher than the first supply voltage, wherein the drive transistor is turned on during at least part of the third time interval, and wherein the second supply voltage is based on the second value of the dynamic supply voltage parameter; and applying, over a fourth time interval, a second parking voltage to the anode of the light-emitting diode and to the channel of the drive transistor, the second parking voltage being less than the first parking voltage, wherein the drive transistor is turned on during at least part of the fourth time interval.

3. The method of claim 1, wherein the first parking voltage is based on the first value of the dynamic supply voltage parameter.

4. The method of claim 3, wherein determining the first value of the dynamic supply voltage parameter comprises:

receiving at least two anchor values of the dynamic supply voltage parameter, based on the first value of the display brightness parameter; and interpolating the at least two anchor values to obtain the first value of the dynamic supply voltage parameter.

5. The method of claim 1, further comprising:

receiving, by the display driver integrated circuit, a value of a dynamic parking voltage parameter, wherein the first parking voltage is based on the value of the dynamic parking voltage parameter.

6. The method of claim 1, further comprising:

transmitting, by the display driver integrated circuit, an anchor value of a dynamic parking voltage parameter that corresponds to the first value of the display brightness parameter; and receiving, in response to transmitting the anchor value of the dynamic parking voltage parameter, the first parking voltage.

7. The method of claim 1, wherein determining the first value of the dynamic supply voltage parameter comprises:

receiving at least two anchor values of the dynamic supply voltage parameter, based on the first value of the display brightness parameter; and interpolating the at least two anchor values to obtain the first value of the dynamic supply voltage parameter.

8. A display driver integrated circuit comprising:

a processor;

a non-transitory computer-readable medium storing instructions that when executed by the processor, cause the processor to perform operations including:

receiving a first value of a display brightness parameter that is a digital quantity that is equal to an amount of light output by a display;

determining a first value of a dynamic supply voltage parameter, wherein the first value of the dynamic supply voltage parameter is based on a stored relation and on the first value of the display brightness parameter;

supplying, to a light-emitting-diode circuit, a first supply voltage based on the first value of the dynamic supply voltage parameter;

transmitting, to the light-emitting-diode circuit, at least one first control signal to apply the first supply voltage, over a first time interval, to one of a gate of a drive transistor of the light-emitting-diode circuit and a channel of the drive transistor, wherein the drive transistor is turned on during at least part of the first time interval;

supplying, to the light-emitting-diode circuit, a first parking voltage that corresponds to the first value of the dynamic supply voltage parameter, the first parking voltage being below a threshold voltage of a light-emitting diode of the light-emitting-diode circuit; and transmitting, to the light-emitting-diode circuit, at least one second control signal to apply the first parking voltage, over a second time interval, to an anode of the light-emitting diode and to the channel of the drive transistor, wherein the drive transistor is turned on during at least part of the second time interval.

9. The display driver integrated circuit of claim 8, wherein the stored relation comprises a plurality of different values of the display brightness parameter and a plurality of different anchor values of the dynamic supply voltage parameter, and wherein the stored relation associates each of the plurality of different values of the display brightness parameter with a different corresponding one of the plurality of different anchor values of the dynamic supply voltage parameter.

10. The display driver integrated circuit of claim 8, wherein the stored relation comprises a plurality of different values of the display brightness parameter and a plurality of different anchor values of a dynamic parking voltage parameter, wherein the stored relation associates each of the plurality of different values of the display brightness parameter with a different corresponding one of the plurality of different anchor values of the dynamic parking voltage parameter.

11. The display driver integrated circuit of claim 8, wherein the operations further include:

receiving at least two anchor values of a dynamic parking voltage parameter, each anchor value of the at least two anchor values of a dynamic parking voltage parameter being based on a display brightness band of a plurality of display brightness bands; and interpolating the at least two anchor values to derive the first parking voltage.

12. The display driver integrated circuit of claim 8, wherein the operations further include:

receiving at least two anchor values of the dynamic supply voltage parameter, each anchor value of the at least two anchor values being based on a display brightness band of a plurality of display brightness bands, wherein determining the first value of the dynamic supply voltage parameter is further based on interpolating the received at least two anchor values.

13. The display driver integrated circuit of claim 8, wherein the operations further include:

transmitting an anchor value of a dynamic parking voltage parameter that corresponds to the first value of the display brightness parameter; and receiving, in response to transmitting the anchor value of the dynamic parking voltage parameter, the first parking voltage.

14. The display driver integrated circuit of claim 8, wherein the operations further include:

receiving a second value of the display brightness parameter that is greater than the first value of the display brightness parameter;

determining a second value of the dynamic supply voltage parameter, wherein the second value of the dynamic supply voltage parameter is based on a stored relation and on the second value of the display brightness parameter, wherein the second value of the dynamic supply voltage parameter is greater than the first value of the dynamic supply voltage parameter;

supplying, to a light-emitting-diode circuit, a second supply voltage based on the second value of the dynamic supply voltage parameter, and transmitting, to the light-emitting-diode circuit, at least one third control signal to apply the second supply voltage, over a third time interval to one of a gate of a drive transistor of the light-emitting-diode circuit and a channel of the drive transistor, wherein the drive transistor is turned on during at least part of the third time interval;

supplying, to the light-emitting-diode circuit, a second parking voltage that corresponds to the second value of the dynamic supply voltage parameter, the second parking voltage being below a threshold voltage of the light emitting diode and less than the first parking voltage; and transmitting, to the light-emitting-diode circuit, at least one fourth control signal to apply the second parking voltage, over a fourth time interval, to an anode of a light-emitting diode of the light-emitting-diode circuit and to the channel of the drive transistor, wherein the drive transistor is turned on during at least part of the fourth time interval.

15. A non-transitory computer-readable medium storing instructions that when executed by a processor, cause the processor to perform operations including:

receiving, by a display driver integrated circuit, a first value of a display brightness parameter that is a digital quantity that is equal to an amount of light output by a display;

determining a first value of a dynamic supply voltage parameter, wherein the first value of the dynamic supply voltage parameter is based on the first value of the display brightness parameter;

applying, over a first time interval, a first supply voltage to one of a gate of a drive transistor of a light-emitting-diode circuit and a channel of the drive transistor, wherein the drive transistor is turned on during at least part of the first time interval, and wherein the first supply voltage is based on the first value of the dynamic supply voltage parameter; and applying, over a second time interval, a first parking voltage to an anode of a light-emitting diode of the light-emitting-diode circuit and to the channel of the drive transistor, wherein the drive transistor is turned on during at least part of the second time interval, and wherein the first parking voltage corresponds to the first value of the dynamic supply voltage parameter and is below a threshold voltage of the light-emitting diode.

16. The non-transitory computer-readable medium of claim 15, the operations further including:

receiving, by the display driver integrated circuit, a second value of the display brightness parameter that is higher than the first value of the display brightness parameter;

determining a second value of the dynamic supply voltage parameter, wherein the second value of the dynamic supply voltage parameter is based on the second value of the display brightness parameter;

applying, over a third time interval, a second supply voltage to the one of the gate and the channel of the drive transistor, the second supply voltage being higher than the first supply voltage, wherein the drive transistor is turned on during at least part of the third time interval, and wherein the second supply voltage is based on the second value of the dynamic supply voltage parameter; and applying, over a fourth time interval, a second parking voltage to the anode of the light-emitting diode and to the channel of the drive transistor, the second parking voltage being less than the first parking voltage, wherein the drive transistor is turned on during at least part of the fourth time interval.

17. The non-transitory computer-readable medium of claim 15, wherein the first parking voltage is based on the first value of the dynamic supply voltage parameter.

18. The non-transitory computer-readable medium of claim 17, wherein determining the first value of the dynamic supply voltage parameter comprises:

receiving at least two anchor values of the dynamic supply voltage parameter, based on the first value of the display brightness parameter; and interpolating the at least two anchor values to obtain the first value of the dynamic supply voltage parameter.

19. The non-transitory computer-readable medium of claim 15, the operations further including:

receiving, by the display driver integrated circuit, a value of a dynamic parking voltage parameter, wherein the first parking voltage is based on the value of the dynamic parking voltage parameter.

20. The non-transitory computer-readable medium of claim 15, the operations further including:

transmitting, by the display driver integrated circuit, an anchor value of a dynamic parking voltage parameter that corresponds to the first value of the display brightness parameter; and receiving, in response to transmitting the anchor value of the dynamic parking voltage parameter, the first parking voltage.

* * * * *